US007575388B2

(12) United States Patent
Shimada et al.

(10) Patent No.: US 7,575,388 B2
(45) Date of Patent: Aug. 18, 2009

(54) BINDER FOR FILING TOOL

(75) Inventors: Hiroshi Shimada, Tokyo (JP); Naotoshi Toda, Tokyo (JP); Tomohiro Yatabe, Tokyo (JP)

(73) Assignee: King Jim Co., Ltd., Tokyo (JP)

( * ) Notice: Subject to any disclaimer, the term of this patent is extended or adjusted under 35 U.S.C. 154(b) by 412 days.

(21) Appl. No.: 10/550,296

(22) PCT Filed: Mar. 31, 2004

(86) PCT No.: PCT/JP2004/004678

§ 371 (c)(1),
(2), (4) Date: Sep. 21, 2005

(87) PCT Pub. No.: WO2004/096575

PCT Pub. Date: Nov. 11, 2004

(65) Prior Publication Data

US 2006/0204320 A1 Sep. 14, 2006

(30) Foreign Application Priority Data

Apr. 30, 2003 (WO) ..... PCT/JP03/05541

(51) Int. Cl.

| | |
|---|---|
| ***B42F 13/06*** | (2006.01) |
| ***B42F 13/08*** | (2006.01) |
| ***B42F 3/00*** | (2006.01) |
| ***B42F 13/12*** | (2006.01) |
| ***A44B 21/00*** | (2006.01) |
| ***A41F 1/00*** | (2006.01) |
| ***B42F 1/00*** | (2006.01) |

(52) U.S. Cl. ..... 402/61; 402/13; 402/15; 402/62; 24/67 R; 24/460; 24/461; 24/462

(58) Field of Classification Search ..... 402/7, 402/8, 13, 15, 60–64, 68; 24/67 R, 460–462
See application file for complete search history.

(56) References Cited

U.S. PATENT DOCUMENTS

| | | | | |
|---|---|---|---|---|
| 828,974 | A | 8/1906 | Schmidmer | |
| 2,727,550 | A * | 12/1955 | Montessi | 150/148 |
| 4,730,972 | A * | 3/1988 | Sun et al. | 412/7 |
| 6,578,240 | B2 * | 6/2003 | Fortenberry | 24/67 R |

FOREIGN PATENT DOCUMENTS

| | | |
|---|---|---|
| GB | 1 200 592 | 7/1970 |
| JP | 151240 | 4/1978 |
| JP | 53-76031 | 6/1978 |
| JP | 60-192696 | 10/1985 |
| JP | 62-162070 | 10/1987 |

OTHER PUBLICATIONS

Microfilm of the specification and drawings annexed to the request of Japanese Utility Model Application No. 158879/1976 (Laid-open No. 76031/1978) (Takeshi Kumagi), Jun. 24, 1978, Full text; all drawings (Family: none).
Israeli Official Action

* cited by examiner

*Primary Examiner*—Dana Ross
*Assistant Examiner*—Kyle Grabowski
(74) *Attorney, Agent, or Firm*—Young & Thompson

(57) ABSTRACT

A binder for filing tools which binds sheets having a plurality of sheet hole parts aligned in the center includes a locking bar which corresponds to a front cover wherein two front cover parts formed from flat boards of which one side of each is respectively connected to a back cover part and integrated. The back cover part includes a plurality of key-shaped locking parts erected on the front surface thereof, the key-shaped locking part is penetrated through the sheet hole parts in the sheet, a plurality of tying parts are provided in the locking bar in positions corresponding to the positions of the key-shaped locking parts, and the sheets are held between the locking bar and front cover by each tying part being locked to the key-shaped locking part.

36 Claims, 23 Drawing Sheets

(a)

(b)

(a)

(b)

(c)

(a)

(b)

BINDER FOR FILING TOOL

TECHNICAL FIELD

The present invention relates to a file and, more particularly, a file which is a binder for facilitating the attachment and removal of a sheet having binding holes, wherein binding of the holes as well as disassembly into respective parts are facilitated.

BACKGROUND ART

As conventional files, for example, a file which has a binding string coated with synthetic resin with flexibility but little expandability and a double row of ribbing erected on the upper surface of a band-shaped board (Japanese Utility Model Laid-Open Publication No. 62-162070), a file comprising a box unit with a cut out for drawers and a bottom plate having a receiving part for fitting, a pressing tool with a U-shaped cross-section, and a stopper tool with a protrusion part for fitting which is fitted onto the receiving part for fitting of the box unit (Japanese Utility Model Laid-Open Publication No. 54-151420), and a file composed of a file front cover, and a band-shaped component comprising a locking part and a locked part (Japanese Utility Model Laid-Open Publication 60-192696), for example, are proposed as conventional files.

All of these proposals comprise conventional filing functions, and considerations towards response to environmental protection are partially made.

Although Japanese Utility Model Laid-Open Publication No. 62-162070 is advantageous in that there are few number of parts, metal parts are not required, and the construction is simple, because there are two binding string holes for holding the file, the load applied to each hole is large, the sheet cannot be secured stably, and it may be insufficient in terms of function when a sheet such as a clear file is attached.

In addition, Japanese Utility Model Laid-Open Publication No. 54-151420 does not require metal parts, comprises a plurality of holes in terms of functionality, and therefore, sheets and the like can be held steadily. On the other hand, as the number of parts increase, attachment and removal becomes less than easy, and its structure is not necessarily simple.

Furthermore, Japanese Patent Laid-Open Publication 60-192696 has few number of parts, does not use metal parts, can hold sheets without fail with a simple structure, and insertion/removal and addition of sheets from in between are possible. However, because a folding-type band-shaped component folded from the top and bottom of the file, is used, there are problems in that exterior deterioration of the folding sections, such as whitening, occurs more easily and it weakens in terms of strength, as well.

Therefore, the present invention provides a simply structured file which facilitates the attachment and removal of sheets having binding holes, wherein, in order to function sufficiently as a file, sheets can be held without fail, insertion/removal and addition in between are facilitated, it is convenient, and furthermore, there are few number of parts and not many types of materials.

DISCLOSURE OF THE INVENTION

The present invention is a binder for filing tools which binds sheets having a plurality of sheet hole parts aligned in the center, comprising a locking bar which corresponds to a front cover wherein two front cover parts formed from flat boards of which one side of each is respectively connected to a back cover part and integrated, wherein the sheets are placed such as to be held between the locking bar and the front cover and filing suitable for the number of sheets to be bound is possible by comprising a space setting means for setting the distance between the locking bar and the front cover.

The space setting means sets distance according to the distance between the front cover and each surface when the locking bar which has a first surface and a second surface which is opposite to the first surface holds the sheet.

In a binder for filing tools which binds sheets having a plurality of sheet hole parts aligned in the center, comprising a locking bar which corresponds to a front cover wherein two front cover parts formed from flat boards of which one side of each is respectively connected to a back cover part and integrated, the back cover part comprises a plurality of key-shaped locking parts erected on the front surface thereof, the key-shaped locking part is penetrated through the sheet hole parts in the sheet, a plurality of tying parts are provided in the locking bar in positions corresponding to the positions of the key-shaped locking parts, and the sheets are held between the locking bar and front cover by each tying part being locked to the key-shaped locking part.

Here, although the key-shaped locking part is locked and fixed to the tying part of the locking bar, the key-shaped locking part can grasp the tying part such as the claims hereafter, and further, the key-shaped locking part can be a locking part comprising a flange part and hole parts can be provided in the tying part of the locking bar and locked.

In a binder for filing tools which binds sheets having a plurality of sheet hole parts aligned in the center, comprising a band-shaped back board which is shorter than the back cover part provided on the front side of a front cover, wherein two front cover parts formed from flat boards of which one side of each is respectively connected to a back cover part and integrated, and a locking bar which corresponds to the band-shaped back board, a plurality of back hole parts are provided in the back cover parts the band-shaped back board comprises a plurality of key-shaped locking parts erected on the front surface thereof, this key-shaped locking part penetrates the plurality of back hole parts provided on the back cover part, the key-shaped locking part penetrates the sheet hole parts of the sheet, a plurality of tying parts are provided in the locking bar on the location corresponding to the locations of these key-shaped locking parts, and the sheet is held between the locking bar and the front cover by locking each tying part to the key-shaped locking part.

Here, by using the band-shaped back board, disassembly and separation of articles are facilitated and environmental measures subsequent to use is facilitated.

The sheets are formed into a transparent pouch-shape wherein the center part is pressure bonded, a plurality of holes are provided and, additionally, an opening part is provided in the upper part. Here, although the pressure bonding in the center part uses generally hot bonding or ultrasonic welding, it can be bonding which uses adhesive and, in addition, includes when the entire center part is pressure bonded and when one portion is welded.

The locking bar comprises a tying part having a small diameter and a pressure part having a diameter larger than that of the tying part. Here, although the ratio of the length of the tying part and the pressure part is not fixed, the longer the pressure part is, the more firmly the sheet is held.

In the locking bar, an attaching concave part is carved into the center thereof in order to insert a thin board enable horizontal movement.

The tying part comprises a locking part, on to which a joining groove is carved in the long axis direction, and a circular part composed of a curved surface.

Here, although the length of the locking groove is arbitrary, by making the width of the groove narrower and the depth shallower, the closer it is to the connected circular part, the more smoothly the key part can move within the locking groove.

The joining groove is notched in four point symmetrical points of the curved surface.

This joining groove is more preferably configured such that two groups of two grooves form a pair.

In the pressure part, the center axis line of the tying part is provided at a slant in a specific direction from the center axis of the pressure part (eccentric structure).

Here, the specific direction is the pressure direction. The increase and decrease in the number of sheets can be handled by adjusting the angle of this slant.

In the key-shaped locking part, key parts which are provided on the tip of the pinching part for sandwiching the locking bar therebetween both protrude inwards. Here, the protrusion comprises both instances when protruding perpendicularly and when protruding with an oblique angle.

In the locking part which is carved onto the tying part, a nonslip protrusion part is formed to protrude from the center thereof to lock the key part.

In the key-shaped locking part, a board-shaped stopper part which is lower in height than the pinching parts is formed between the opposing pinching parts to protrude perpendicular to the back cover part. The height of this stopper part is a value determined by the circular part of the locking bar, and can be configured arbitrarily.

The joining groove and the joining groove bottom part of the locking bar are carved at an acute angle in accordance to the key-shaped locking part of the engaging band-shaped back board. The engagement becomes stronger by carving at an acute angle.

Ribbing is provided and a plurality of hole parts in a shape wherein two circles of differing diameters are partially joined is formed on the one side peripheral part of the locking bar.

The locking bar is formed in a rectangle and the ribbing is formed on the outer four-side edge part to protrude perpendicularly and outwards to a surface of the locking bar.

The locking bar has a plurality of hole parts drilled along its long axis in predetermined locations, the hole part is formed such that an release diameter hole part having a large diameter and a lock diameter hole part having a small diameter partially overlap, and a locking groove part provided on the protrusion part which is formed to protrude perpendicularly from the back cover part is locked and held in the hole part.

The locking bar is formed from an arc-shaped curved surface, of which the center is the center of axle, and a flat surface and penetrates the circular hole part which passes through, parallel in the long axis direction of the back cover part, the protrusion part which is formed to protrude perpendicularly from the back cover part.

The locking bar is rectangular, grooves are carved on the surface opposing a plurality of ribbings protruding from the entire long-side edge, and the grooves interlock with an orbital ribbing provided on the protrusion part which protrudes perpendicularly from the back cover part.

The locking bar comprises ribbing protruding perpendicularly on the surfaces on both long sides of one surface, a rectangular hooking hole part provided on the one edge part of the ribbing and a first pin hole drilled on the other edge part of the ribbing, respectively, is composed of a flat board which is erected perpendicular to and opposing the back cover part, a second pin hole which is drilled in the center of the flat board, a pin which penetrates the first pin hole and the second pin hole and holds the locking bar to enable rotation, and a second flat board part which is formed to protrude perpendicular to the back cover part from the holding part provided on the other edge of the back cover part and comprises a latching part on the side surface, and the latching part locked onto the hooking hole part and holds the locking bar.

The locking bar comprises a carved part which is carved into a plurality of circles, a slit which is cut into the center of the carved part, and a protrusion which comprises orbital ribbing, formed to protrude by the back cover part, and the locking bar is fixed onto the protrusion.

The locking bar is composed of a flexible locking bar which has flexibility.

BEST MODES FOR CARRYING OUT THE INVENTION

Other details, advantages and characteristics of the present invention are clarified by the six embodiments described hereafter, with reference to the attached drawings.

A first embodiment of the present invention is described in detail hereafter, with reference to the drawings.

Figure 1:
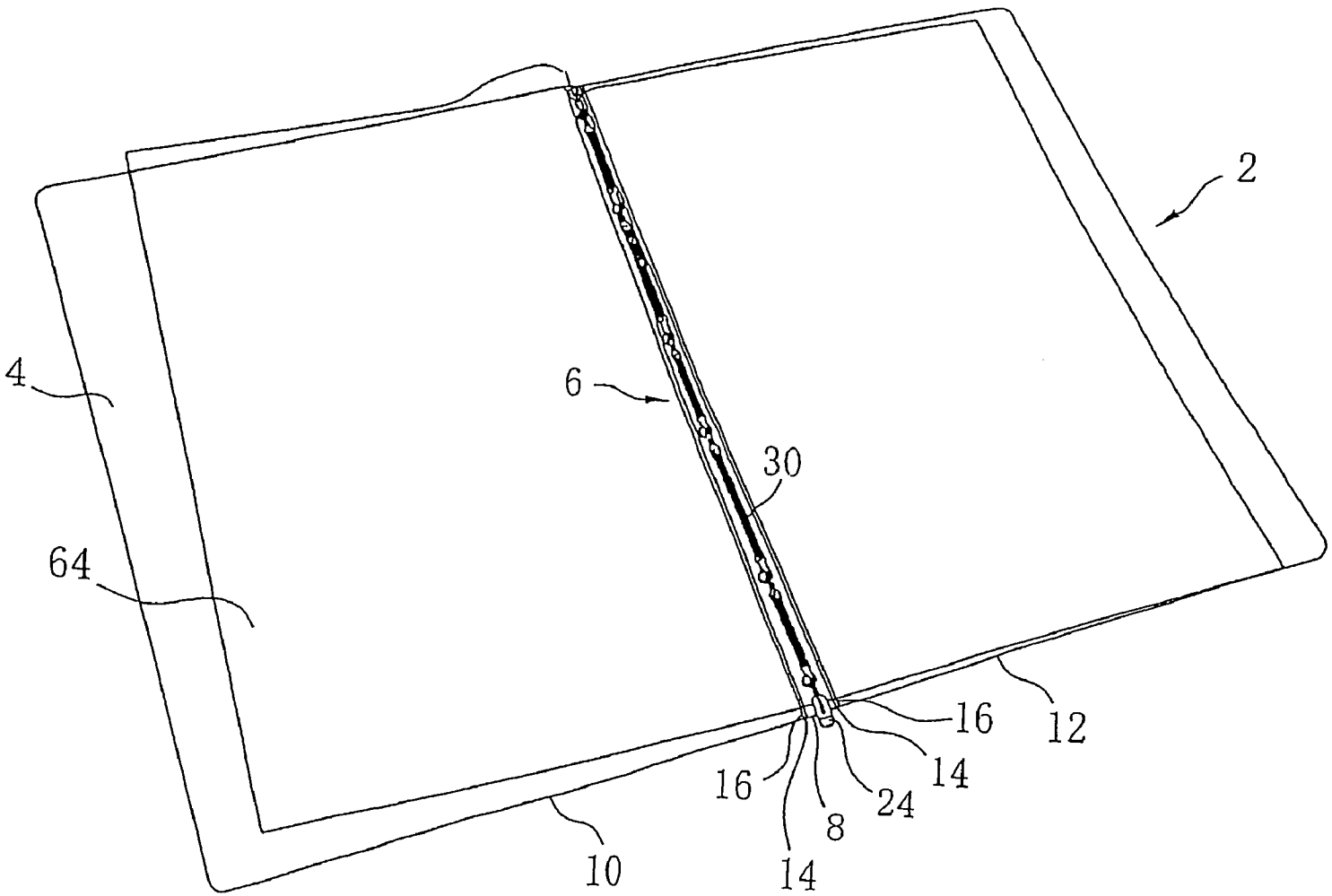
FIG. 1 is an overall view showing a first embodiment of the binder for filing tools according to the present invention.
Figure 2:
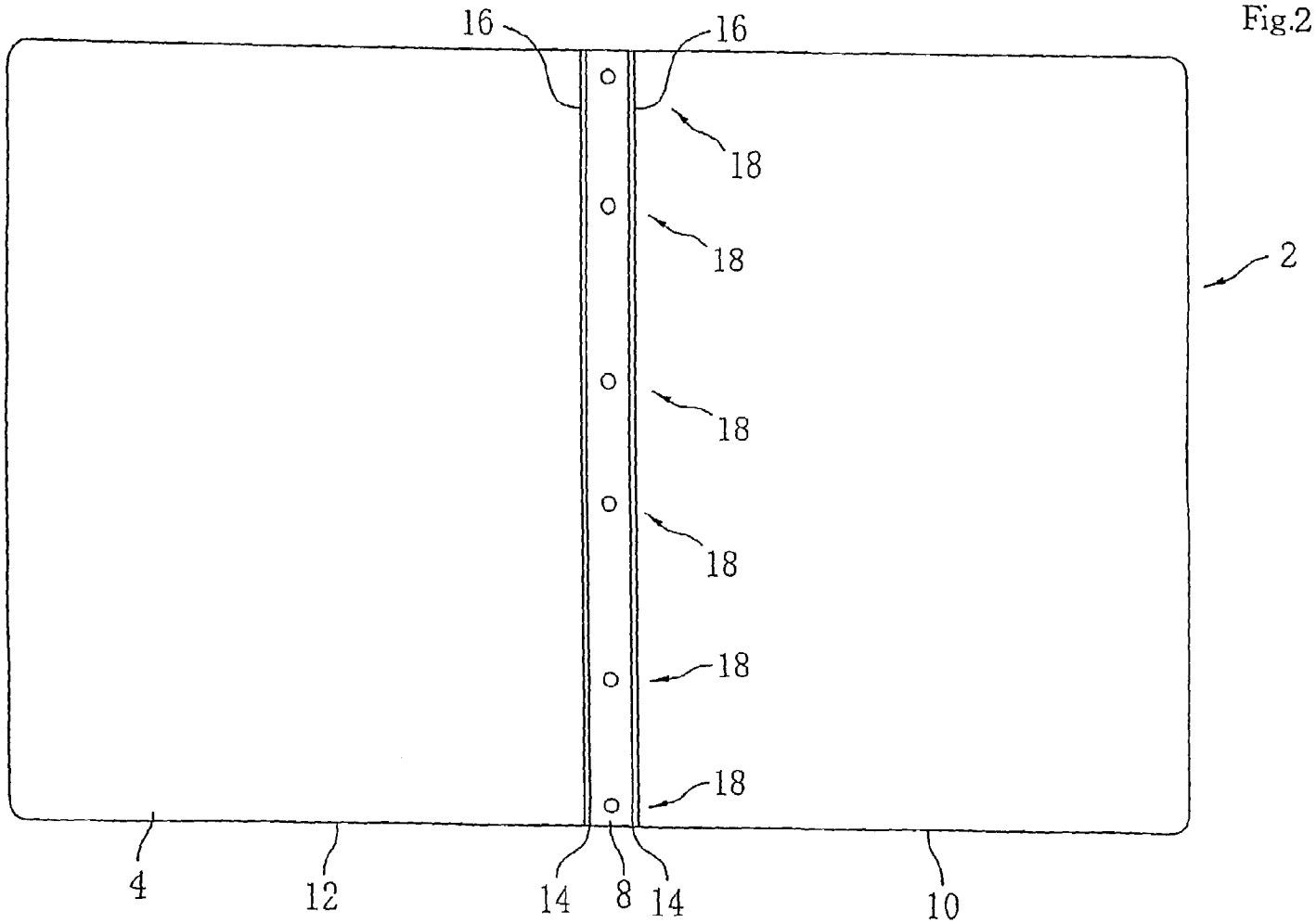
FIG. 2 is a top view of a front cover showing the first embodiment of the binder for filing tools according to the present invention.

File 2 comprises a file main unit 4 and a binder for filing tools 6, as shown in FIG. 1. The file main unit 4 and the binder for filing tools 6 are synthetic resin moldings, and integral molding has been performed on the file main unit by extrusion molding or injection molding and on the binder for filing tools by injection molding or the like. File main unit 4 comprises a vertically long rectangular back cover part 8 and a pair of vertically long rectangular front cover parts 10 and 12 which are connected with the back cover part 8 in between, on both sides of its long side. As shown in FIG. 2, a first hinge 14 which is formed from a V-shaped groove wherein the thickness becomes thin due to the thickness of file main unit 4 is formed on the border of the back cover part 8 and the front cover parts 10 and 12, and the front cover parts 10 and 12 can be folded easily, due to this first hinge 14, from the back cover part 8 or, in other words, can be opened and closed.

In the vicinity of the back cover part 8 in the pair of front cover parts 10 and 12, a second hinge 16 of the same cross-sectional V-shape is formed a predetermine distance from and parallel to the first hinge 14, and each front cover part 10 and 12 can be folded due to this second hinge 16. A plurality of back hole parts 18 are provided in one row in the long side direction in the center part of the short side direction of the back cover part 8. The back hole parts 18 are aligned with a predetermined distance therebetween.

The binder for filing tools 6 comprises a flexible locking bar 20 which can be locked in a plurality of flexible places and a band-shaped back board 22 comprising a plurality of engaged parts. The entire length of the flexible locking bar 20 is almost the same length as the long side of back cover part 8, as shown in FIG. 3 to FIG. 6, has a flat grasping part 24 on one edge part and a locking edge part 26 on the other edge. A plurality of tying parts 28 and pressure parts 30 are aligned between the grasping part 24 and the locking edge part 26 of the flexible locking bar 20 such as to be alternately interlocked.

Figure 5:
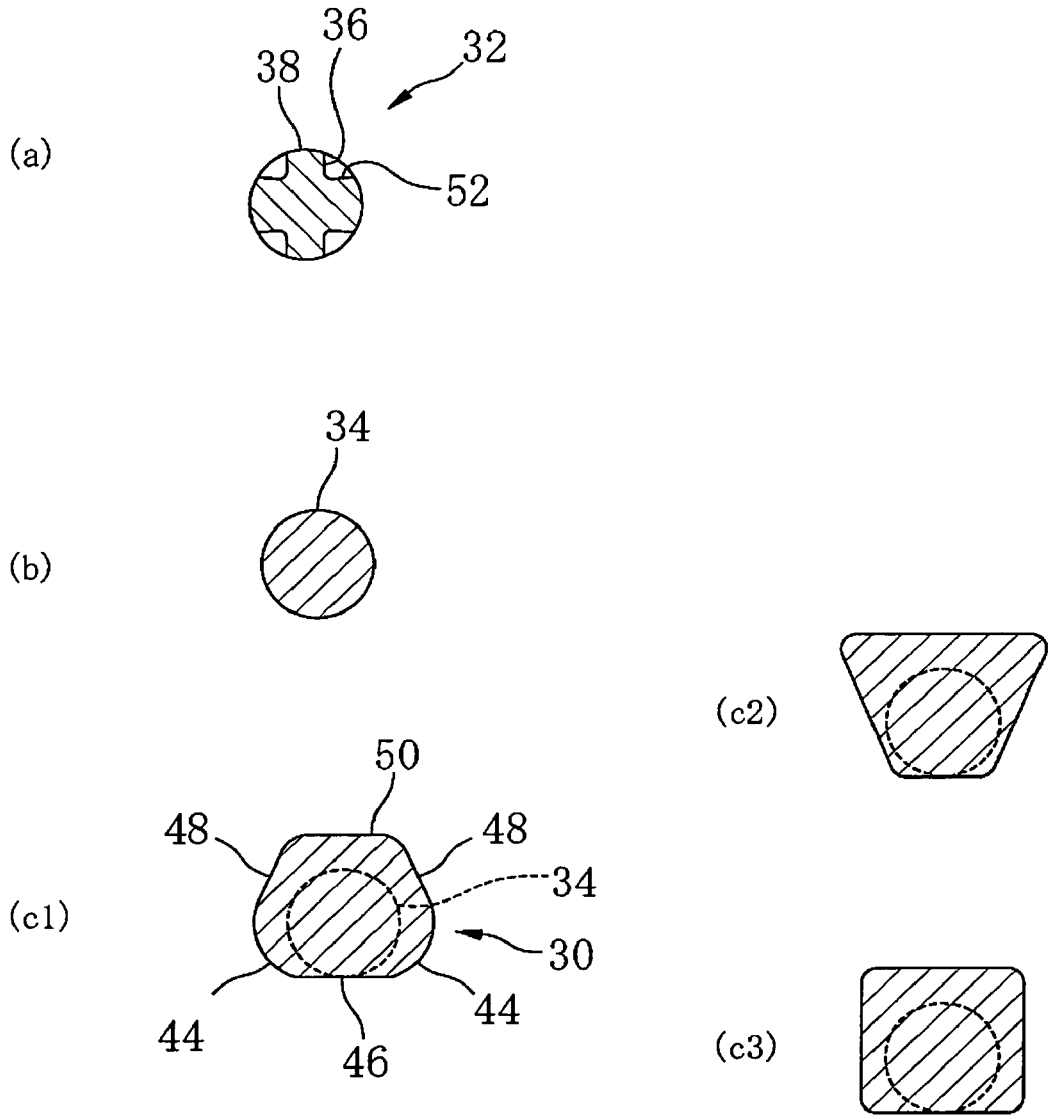
FIG. 5 shows an embodiment of the locking bar in the binder for filing tools according to the present invention and is: (*a*) an A-A cross-sectional view; (*b*) a B-B cross sectional view; (*c*1) a C-C cross-sectional view; (*c*2) a C-C cross-sectional view, wherein the upper bottom surface is wider than the lower bottom surface; (*c*3) a C-C cross-section, wherein the width of the upper bottom surface and the width of the lower bottom surface is roughly equal.
Figure 6:
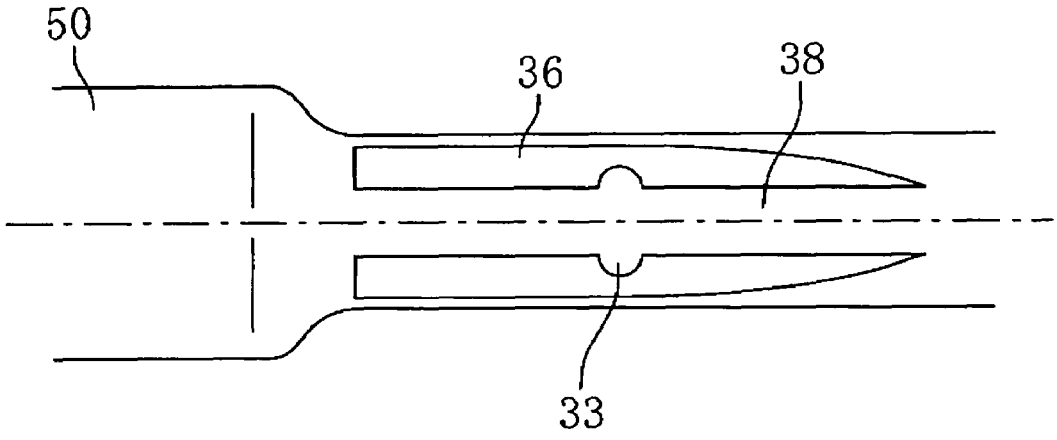
FIG. 6 is a detail view showing an embodiment of the locking bar in the binder for filing tools according to the present invention.

This tying part 28 is provided in a position corresponding to the back hole part 18 in the back cover part 8. In the tying part 28, locking part 32 onto which the joining groove is carved in the long axis direction and a circular part 34 which is formed from a curved surface are interlocked. In the locking part 32, as shown in FIG. 5(*a*) which is an A-A cross-sectional diagram of FIG. 3, joining grooves 36 are carved in the four corners and the circular front surfaces 38 and joining grooves 36 are aligned alternately in the circumferential direction. In the axis direction of the tying part 28, the joining grooves 36 are carved almost to the center of the typing part 28 and one side which is the pressure part 30 side is carved into a wide-shape and, in contrast, in the circular part 34 side, adjacent joining grooves 36 are carved into narrow tip-shape wile adjacent (FIG. 6). Although joining grooves 36 can be carved at a right-angle to the joining groove bottom part 52, it is preferable to strengthen the engagement by carving into an acute angle and matching with the angle of the key part 60 of the engaging band-shaped back board.

The circular part 34 has no cuts whatsoever, and is formed from a smooth circular surface, as shown in the B-B cross-sectional view in FIG. 5(*b*). Here, the locking part 32 has the same radius as the circular part 34 or the radius of the locking part 32 is smaller than the radius of the circular part 34. In FIG. 5, an example with the same radii is shown. In addition, the locking part 32 and the circular part 34 are placed on the same axis.

The pressure part 30 has a first bottom surface 46 which is connected to two R surfaces 44 having a predetermined R on both long sides, respectively, and a second bottom surface 50 which is connected to two taper surfaces 48, connected to R surfaces 44, on both long sides, respectively, and provided such as to be parallel with the first bottom surface 46, as shown in the C-C cross-sectional view in FIG. 5(*c*1). However, the shape of the cross-section is not limited to FIG. 5(*c*1), the center axes of the first bottom surface, the second bottom surface, and the pressure part 30 are not on the same axis as the center axis of the connected tying part 28, and the center axis of the tying part 28 is connected such as to shift towards the first bottom surface 46 to the degree that the outer circumference of the tying part 28 contacts the first bottom surface 46 (eccentric structure) (refer to FIGS. 5(*c*2) and (*c*3)).

Figure 3:
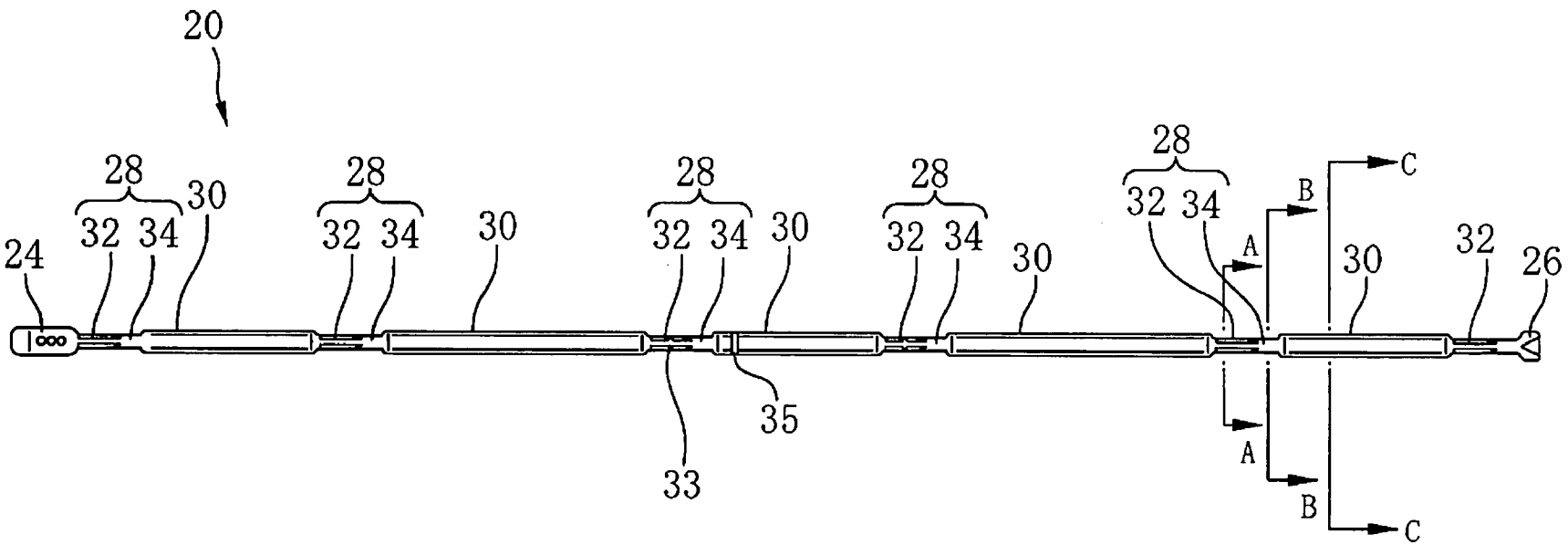
FIG. 3 is an elevation view showing the first embodiment of the locking bar in the first embodiment of the binder for filing tools according to the present invention.
Figure 4:
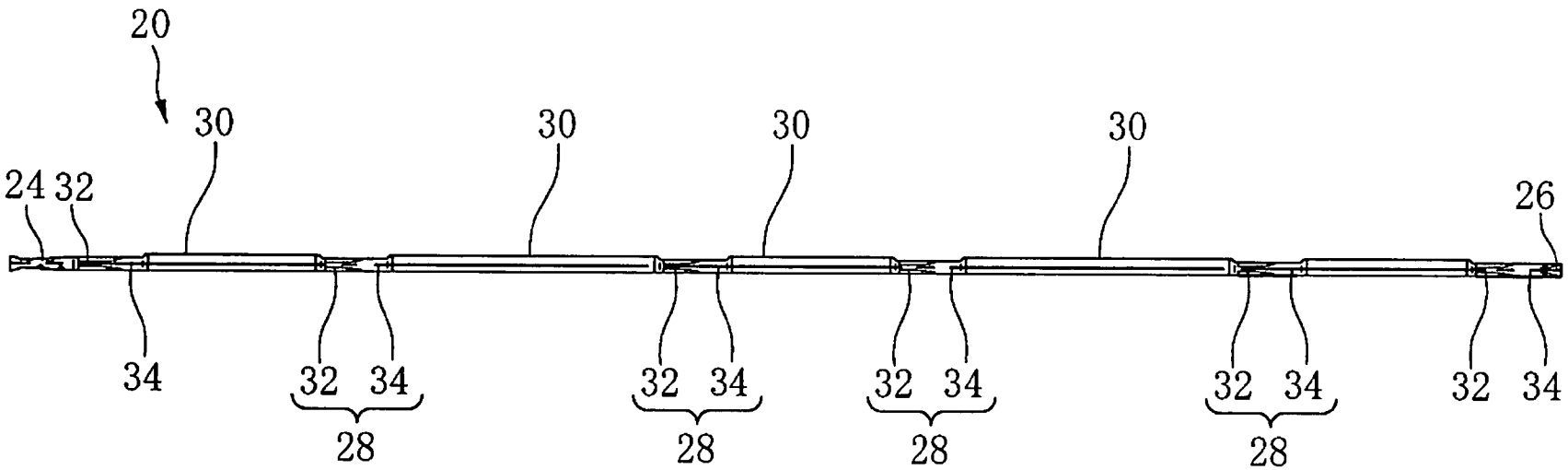
FIG. 4 is a side view showing an embodiment of the locking bar in the first embodiment of the binder for filing tools according to the present invention.

As shown in FIG. 3, in the locking part 32 of the plural tying parts 28 of the flexible locking bar 20, a non-slip protruding part 33 is formed to protrude from the center thereof. This slip stopper is to prevent side to side movement by locking the key part 60 of the key-shaped locking part 56 with the flexible locking bar 20 when locking the flexible locking bar 20. Non slip protruding part 33 can be provided on all tying parts 28 or can be provided only on about two central tying parts 28.

In addition, in the flexible locking bar 20, an attaching concave part 35 is carved vertically in the long side direction of the flexible locking bar 20 on the center pressure part 30 out of a plurality of pressure parts 30. When sliding the flexible locking bar 20 by this attaching concave part 35, sliding can be facilitated by using coins or the like.

Figure 7:
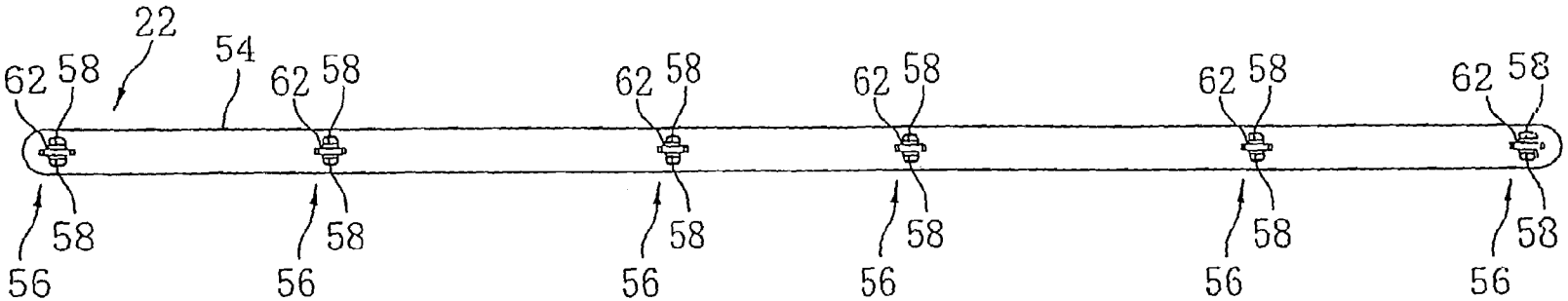
FIG. 7 is an elevation view showing an embodiment of a band-shaped black board in the binder for filing tools according to the present invention.
Figure 8:
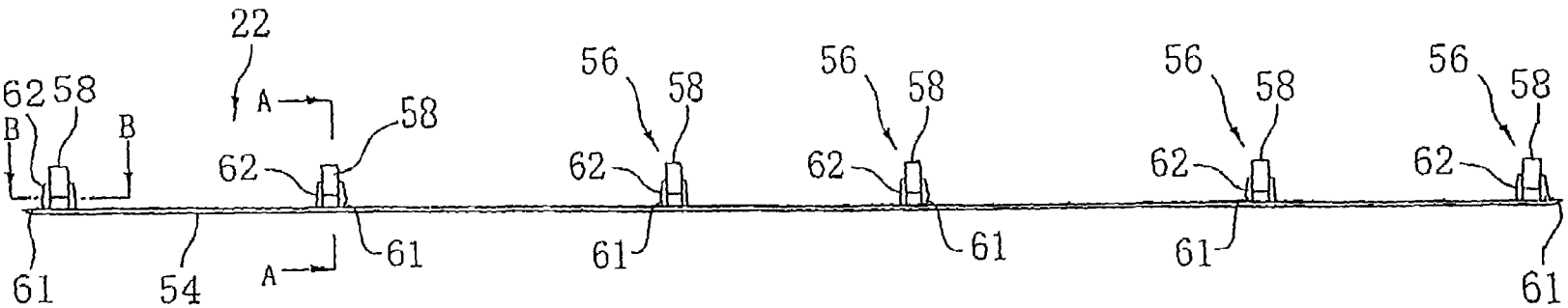
FIG. 8 is a side view showing an embodiment of a band-shaped black board in the binder for filing tools according to the present invention.
Figure 9:
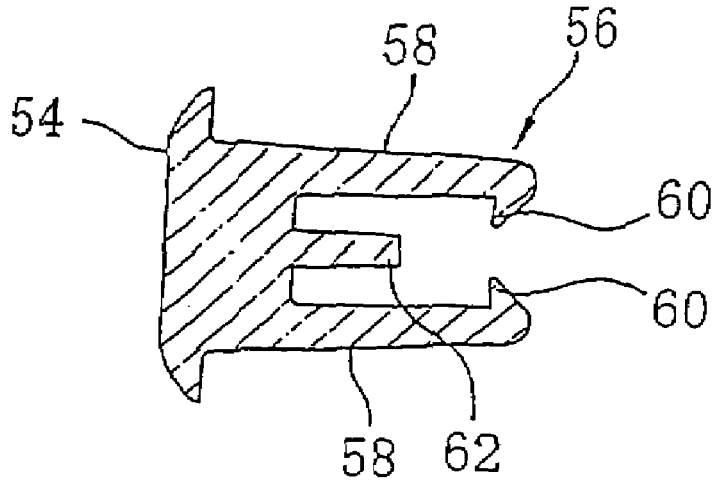
FIG. 9 is (*a*) an A-A cross-sectional view, and (*b*) a B-B cross-sectional view of FIG. 8 showing an embodiment of a band-shaped black board in the binder for filing tools according to the present invention.
Figure 9:
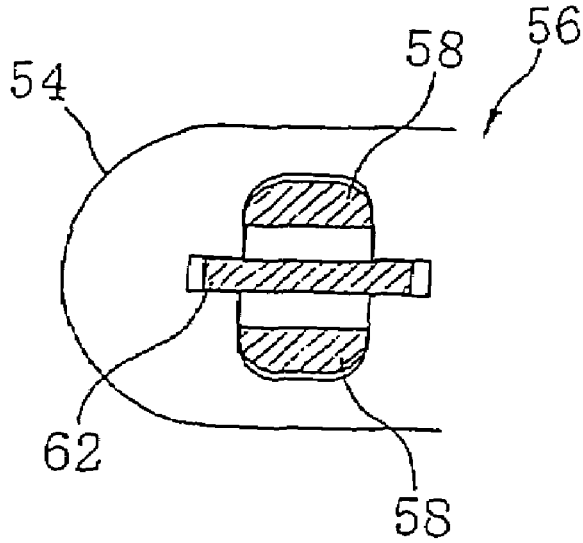
Figure 10:
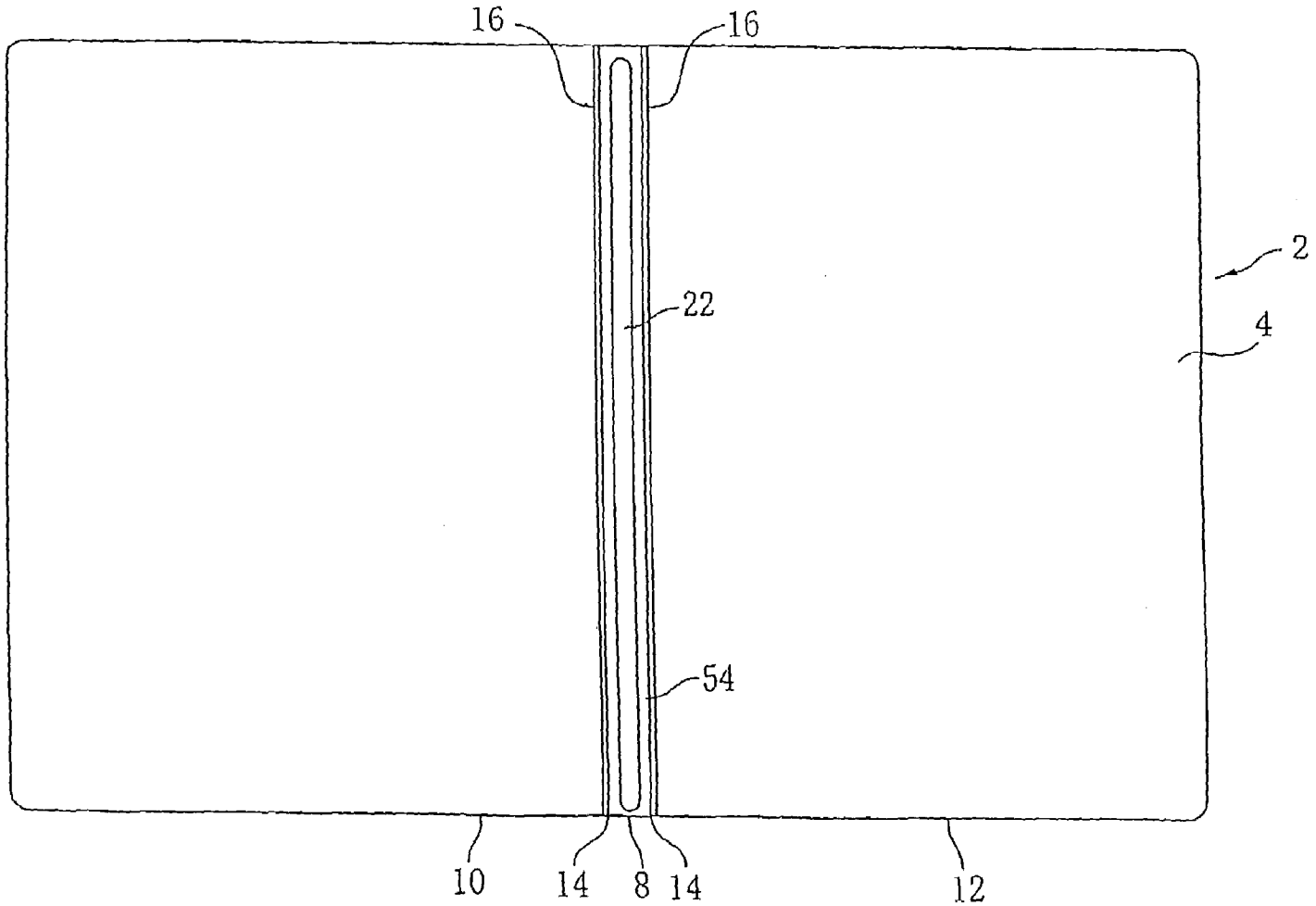
FIG. 10 is a rear elevation view showing an embodiment of the binder for filing tools according to the present invention.

On the other hand, in the band-shaped back board 22 which is another constituent element of the binder for filing tools 6, a plurality of key-shaped locking parts 56 are erected on the bottom board part 54, in every position corresponding to the tying part 28 and the back hole part 18, as shown in FIG. 7 to FIG. 9. In this key-shaped locking part 56, two pinching boards 58 are erected on the bottom board part 54 side by side in the short side direction of the bottom board part 54 such as to oppose with other. Key parts 60 are formed to protrude perpendicularly on the upper edge side parts of the pinching boards 58, and the key parts 60 of both pinching boards 58 protrude such as to face inwards, towards each other. In addition, by lowering the edge part of the key parts 60 in the lower direction, carving the joining groove bottom part 52 as an acute angle to the pinching board 58 such as to become parallel with this key part 60, and engaging the key part 60 and the joining groove bottom part 52, this engagement can be strengthened. At the foundation of the pinching board 58, adjacent pinching boards 58 are connected with each other by a side board. In addition, a stopper part 62 is erected parallel to the pinching board 58, between the two pinching boards 58, and its height is set to a height lower than the under edge part of the key part 60 by about the diameter of the circular part 34. Furthermore, the diameter of the bottom surface of the key-shaped locking part 56, which is a portion including the pinching board 58 and the stopper part 62, is set to be smaller than the diameter of the back hole part 18, and the key-shaped locking part 56 is designed such as to enable insertion to the back hole part 18. Here, the diameter of the bottom surface is the diameter of the smallest circle in contact with the shape joined to the pinching board 58 and the bottom board part 54 of the stopper part 62.

In the key-shaped locking part 56, shown in FIG. 8, a front cover locking notch part 61 for locking the front cover part to one side of the engagement portion of the stopper part 62 and the bottom board part 54 is provided.

Figure 14:
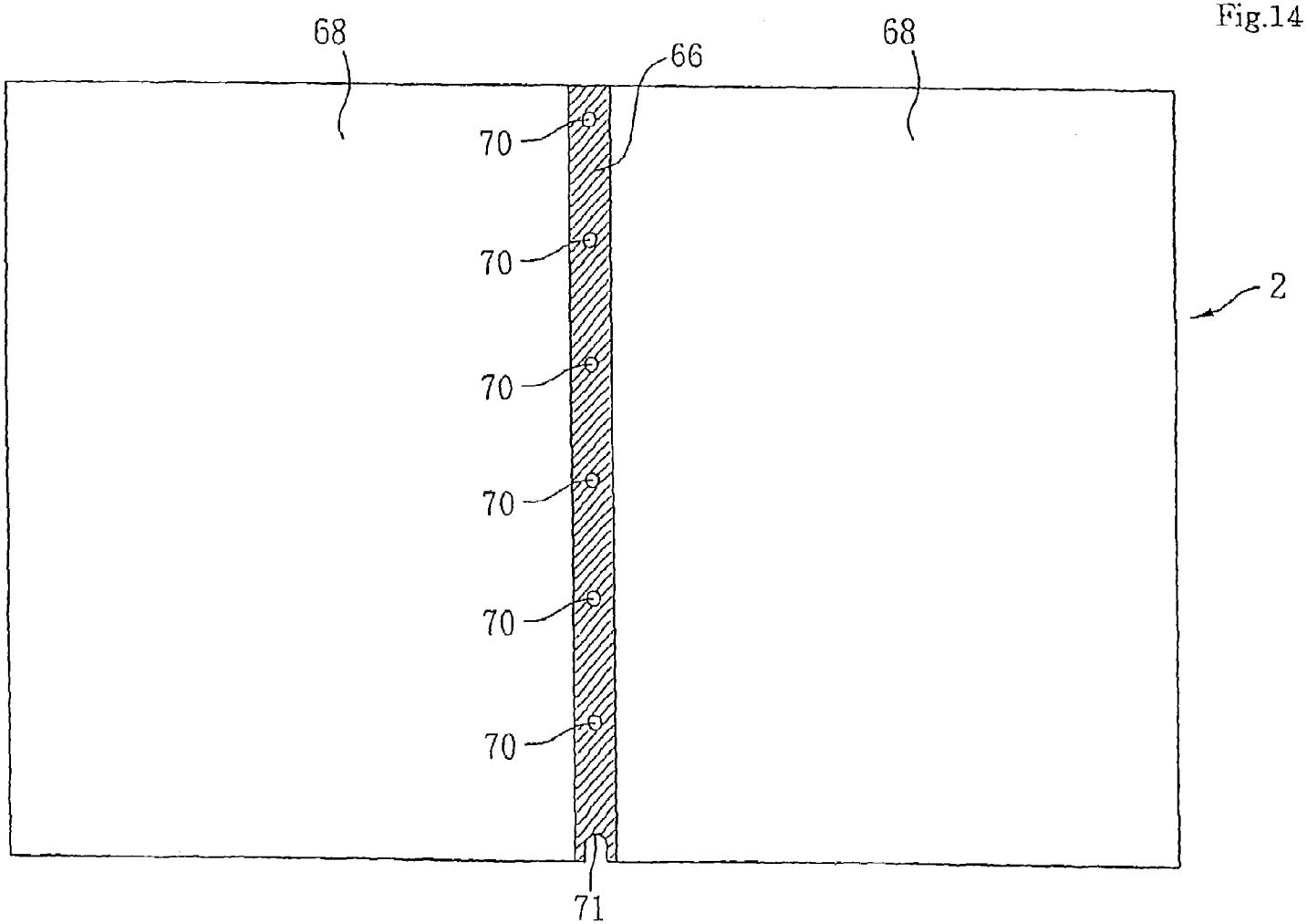
FIG. 14 is a configuration diagram showing the sheet in the first embodiment of the binder for filing tools according to the present invention.

Sheet 64, which is inserted into this file, comprises one each of a vertically long rectangular center part 66 and a pouch part 68 wherein two vertically long rectangular sheets connected to both sides of the long sides of the center part 66, which is sandwiched therebetween, are welded excluding one side. This center part 66 is welded and sheet hole parts 70 which are aligned in the center with the same distance in between as the tying parts 28 or, in other words, the same distance in between as the back hole parts 18 are provided. A sheet notch part 71 for verifying the top and bottom of sheet 64 is provided on the lowermost part of the center part 66 of sheet 64. This pouch part is formed from transparent film for inserting papers and the like (FIG. 14).

The directions for use of the file 2 which is composed of the foregoing elements are shown using FIG. 10 to FIG. 14. First, a key-shaped locking part 56, which is provided in the band-shaped back board 22, is inserted into the back hole part 18 provided in the back cover part 8 of the file main unit 4. Furthermore, the key-shaped locking part 56 is inserted into the sheet hole part 70 of sheet 64, inserted into this file 2. In this way, file main unit 4 and sheet 64 are held to the key-shaped locking part 56.

Next, the flexible locking bar 20 is arranged on the band-shaped back board 22 such that each circular part 34 corresponds to each protruding key-shaped locking part 56. Then, by pressing every circular part 34, the circular parts 34 are sandwiched within the key-shaped locking part 56. At this time, the circular part 34 comes in to contact with the stopper part 62 and stops (FIG. 13(*b*)). An example wherein the diameter of the circular part 34 is smaller than the diameter of the locking part 32 is shown (FIGS. 13(*b*) and (*c*)), and the key-shaped locking part 56 can be attached and removed with more ease if the diameter of the circular part 34 is small.

Furthermore, the position of the key part 60 moves from the circular part 34 to the locking part 32 by pressing the grasping part 24 of the flexible locking bar 20 in the horizontal direction and sliding the flexible locking bar 20 in the axis direction. At this time, the key part 60 is interlocked by the joining groove 36. This state is the state shown in FIG. 13(*a*).

Figure 11:
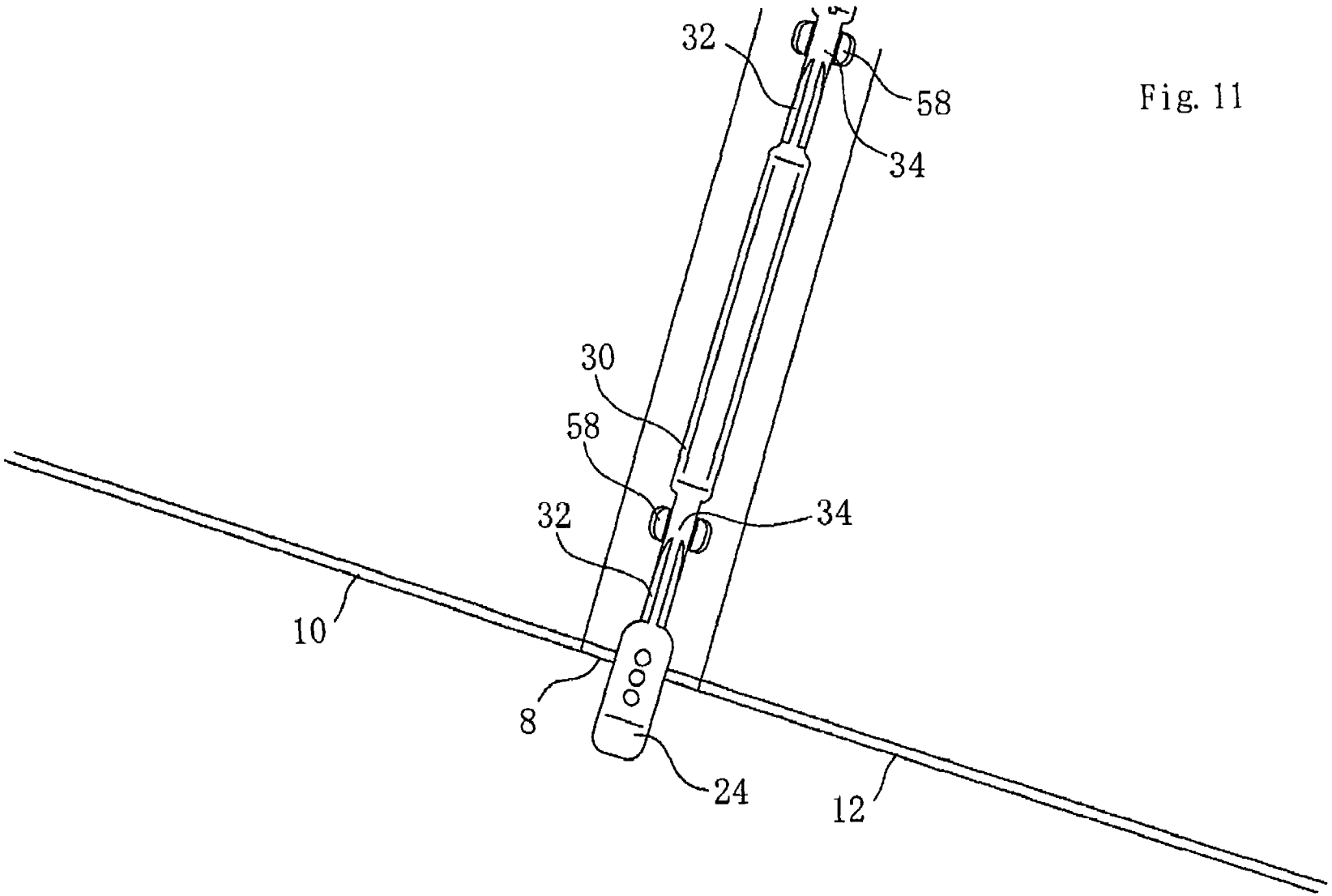
FIG. 11 is a detail view showing an embodiment of the binder for filing tools according to the present invention.

Next, if the number of sheets 64 is large, the position of the key part 60 moves from the locking part 32 to the circular part 34 by pulling the grasping part 24 of the flexible locking bar 20 in a horizontal direction and sliding the flexible locking bar 20 in the axis direction (FIG. 11). Here, a large number of sheets 64 can be held if the first bottom surface 46 of the pressure part 30 is placed on the lower surface such as to press the sheets 64. In other words, because the center axis of circular part 34 is not aligned with the centre axis of the pressure part 30, the distance of the rotation center and the first bottom surface 46 is short by making the first bottom surface 46 the lower part and the pressure part 30 can hold the sheets 64 effectively including R surface 44 because both sides of the first bottom surface 46 is R surface 44.

On the other hand, if the number of sheets 64 is a few, a few numbers of sheets 64 can be held if the second bottom surface 50 of the pressure part 30 is placed on the lower surface such as to press the sheets 64. In this case, by making the second bottom surface 50 the lower part, the distance of the rotation center and the second bottom surface 50 becomes long and the pressure part can hold the sheets 64 effectively. After determining the foregoing bottom part, the position of the key part 60 moves from the circular part 34 to the locking part 32 and the key part 60 is interlocked by the joining groove 36 when the grasping part 24 of flexible locking bar 20 is pressed in the horizontal direction and the flexible locking bar 20 is slid in the axis direction.

In this way, ideal pressing and holding can be performed by the flexible locking bar 20 according to the number of sheets 64.

Figure 12:
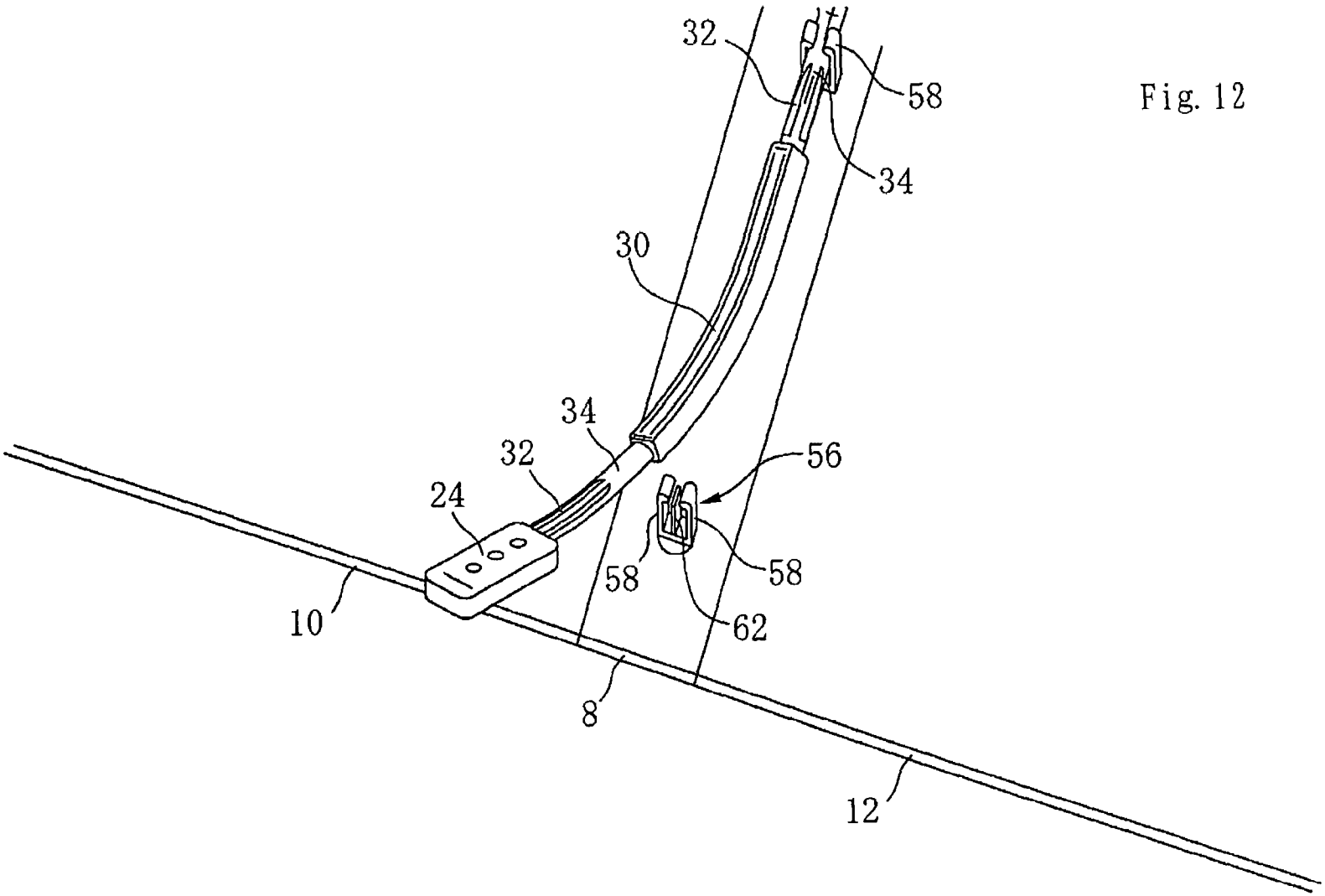
FIG. 12 is a detail view showing an embodiment of the binder for filing tools according to the present invention.
Figure 13:
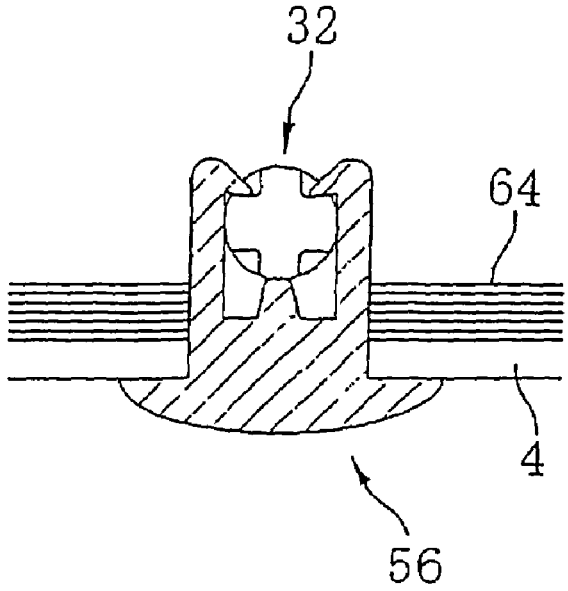
FIG. 13 shows an embodiment of the binder for filing tools according to the present invention and is: (*a*) a cross-sectional view when key-shaped locking part 56 is in locking part 32; (*b*) a cross-sectional view when key-shaped locking part 56 is in circular part 34; and (*c*) a cross-sectional view when circular part 34 is released from key-shaped locking part 56.
Figure 13:
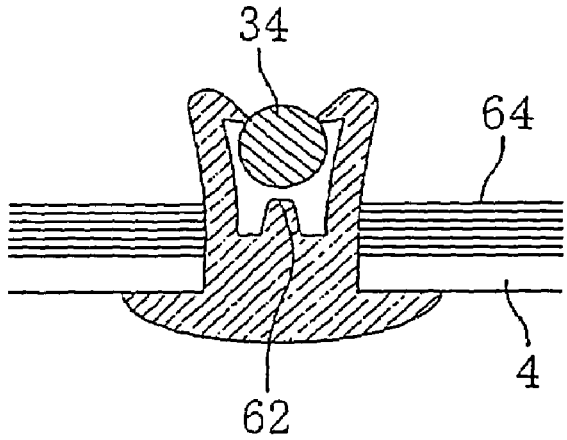
Figure 13:
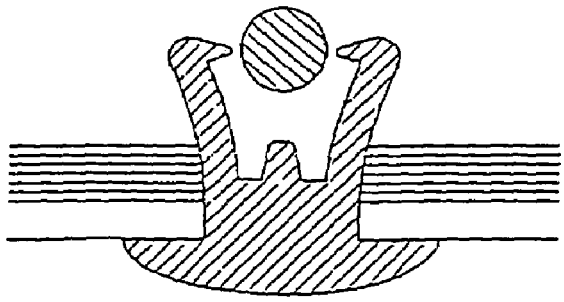

Next, in order to release sheets 64 from the file 2, first, the position of the key part 60 moves from the locking part 32 to the circular part 34 by pressing the locking edge part 26 of the flexible locking bar 20 in the horizontal direction and sliding the flexible locking bar 20 in the axis direction. If the grasping part 24 is pulled up in this state, each circular part 34 of the flexible locking bar 20 is easily released from each key-shaped locking part 56, in sequential order from the edge part (FIG. 12 and FIG. 13C). After all circular parts 34 are released by this method, the object removal and attachment of sheets 64 become possible.

In other words, by implementing the binder for filing tools according to the present invention, the removal and attachment of sheets can be facilitated. In addition, because the sheets 64 are held by a plurality of key-shaped locking parts 56, dispersion of sheets 64 due to the detachment of the binder for filing tools 6 does not occur.

In addition, in terms of segregated disposal and recycling of file 2, is can be easily disposed as well as easily recycled because the sheets 64 are removed after the flexible locking bar 20 is released and the file is separated into the file main unit 4 and the band-shaped back board 22. Furthermore, because all materials are composed of the same resin and the like, disposal is facilitated in this regard as well.

According to the foregoing embodiments, the following effects are obtained:

Sheets 64 can be held by the center axis of the circular part 34 shifting the center axis of the pressure part 30, regardless of the amount of sheets 64. In addition, sheets 64 can be held without fail and, on the other hand, removal and attachment is facilitated as well by combining the flexible locking bar 20 and the band-shaped back board 22.

In addition, there are few components comprising file 2, the flexible locking bar 20, the band-shaped back board 22 and the file main unit 4, component costs and manufacturing costs can be reduced. Furthermore, because the structure is simple, not only are the manufacturing procedures for structural elements reduced, but malfunctions and breakage during use can also be reduced.

Still further, because all of the components comprising file 2 are formed from resin and does not require metal parts at all, the reduction of costs by reducing manufacturing procedures and disposal and recycling are facilitated, and the weight of the main body can be reduced. Furthermore, by changing the colorant combined with resin, the implementation of designs including various colors becomes possible.

The present invention is not limited to the foregoing embodiment, and modifications and improvements within the range of achieving the object of the present invention are included in the present invention. For example, the band-shaped back board 22 and the file main unit 4 are separate constructions in the foregoing example, it is not limited thereto. In other words, the key-shaped locking part 56 can be erected in the file main unit 4, beforehand, and integrated. Either construction can be used as long as the flexible locking bar 20 can be locked without fail. However, because costs can be reduced by not making the injection molding metal mold any more complex than required and rigidity due to making these parts separate can be maintained by having separate constructions as in the present embodiment, the present embodiment is preferable.

Although there are six key-shaped locking parts 56 and tying parts 28 in this embodiment of the present invention, these amounts are not limited and, though construction is possible if there are at least two, three or more are preferable, and it can be any number as long as it is a number which can be applied.

Figure 15:
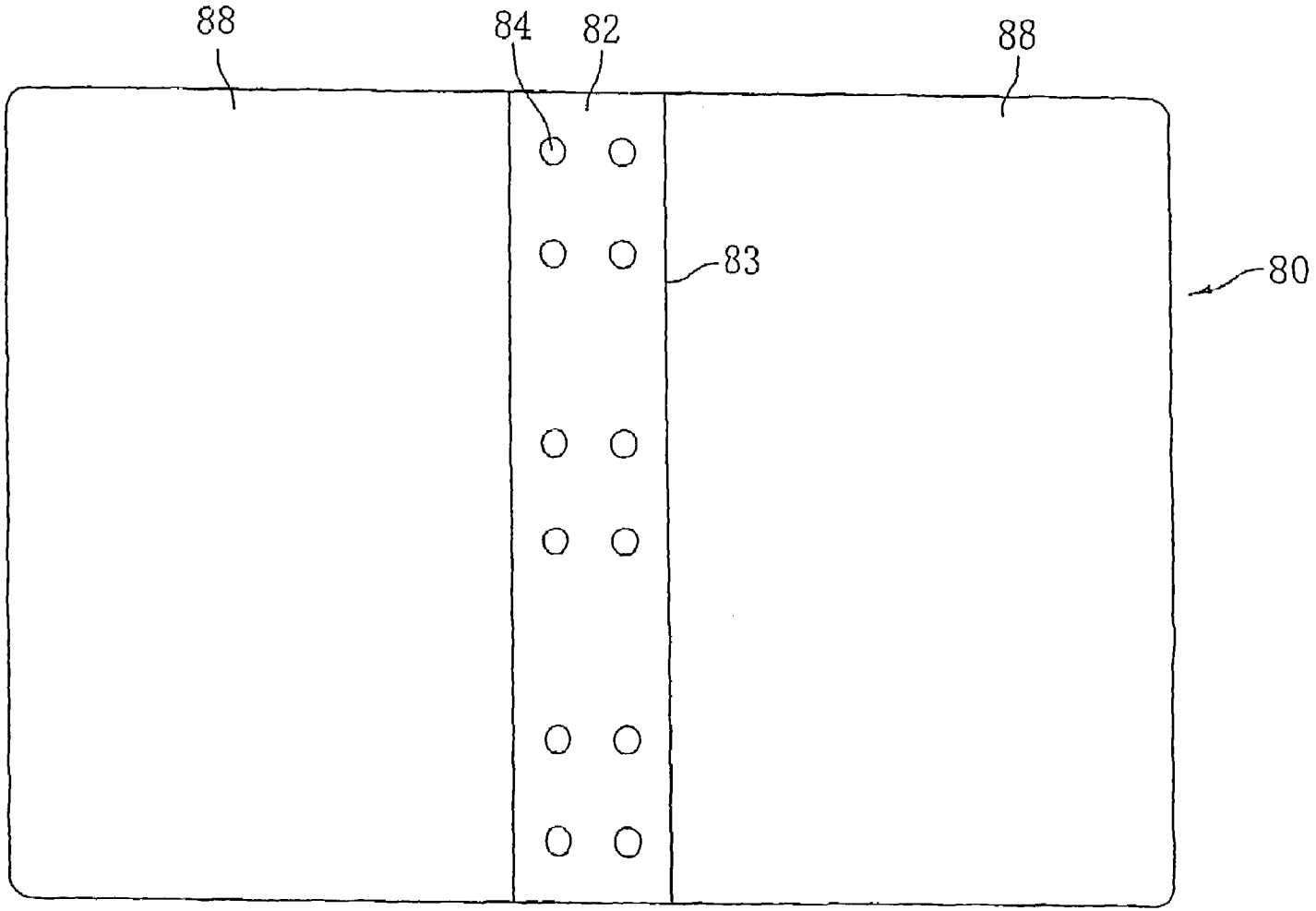
FIG. 15 is a top view of a front cover showing an example wherein there are plural binder parts in the first embodiment of the binder for filing tools according to the present invention.
Figure 16:
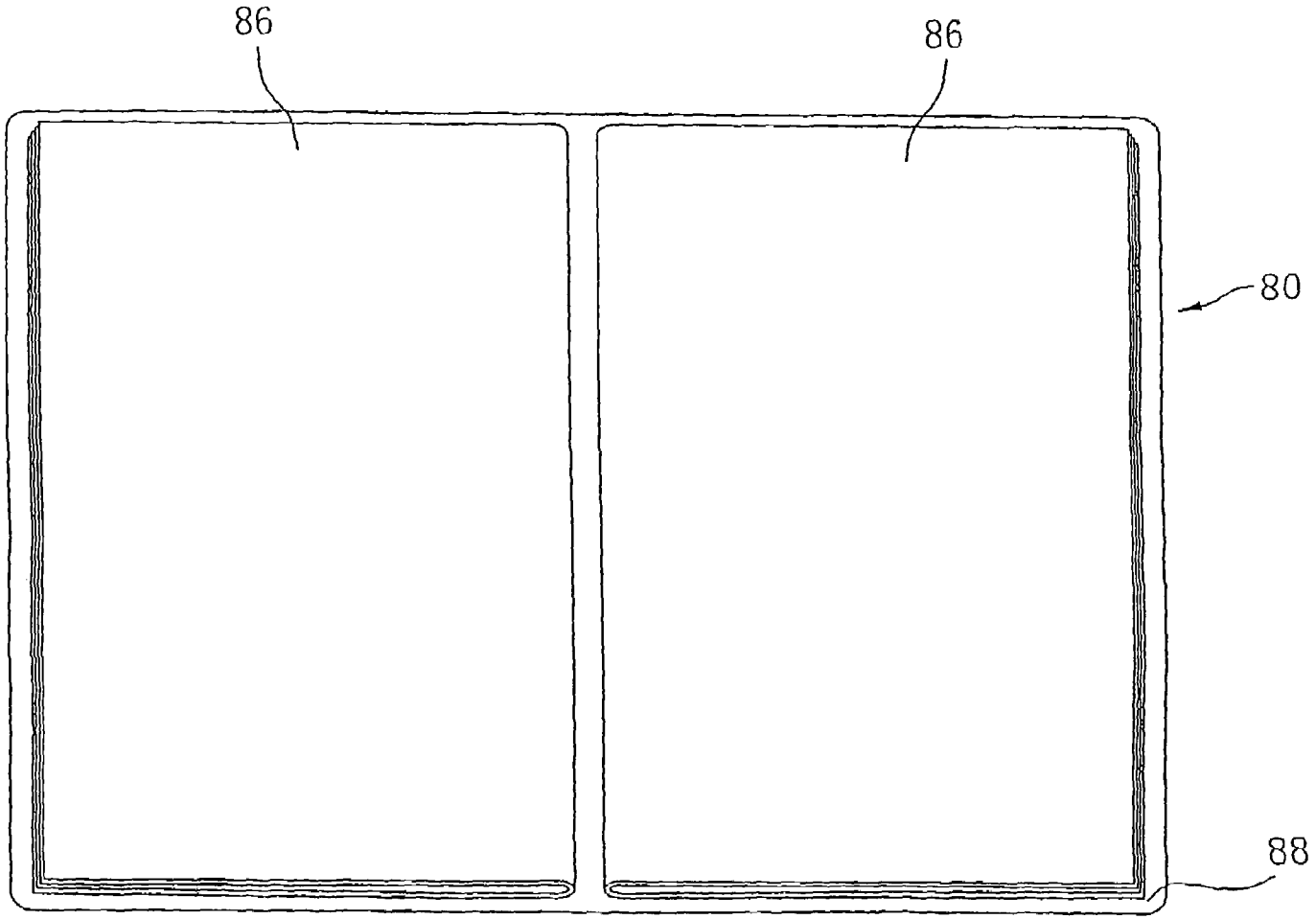
FIG. 16 is an entire view showing an example wherein there are plural binder parts in the first embodiment of the binder for filing tools according to the present invention.

In addition, it is possible to bind more sheets by providing plural pairs of binder parts in parallel on one file main unit. In FIG. 15, a file main unit 80, which is an example wherein two pairs of binder parts are provided, is shown. Two rows of back hole parts 84 are provided on the back cover part 82 in parallel to the long side direction of the back cover part 82, and the front cover part 88 and back cover part 82 are constructed such as to bend on a single hinge 83. In FIG. 16, an entire view of the file when two pairs of sheets 86 are bound to the front cover part 88 is shown.

Furthermore, although the cross-section of the pressure part 30 is a shape comprising two flat surfaces, it can be constructed such that one is an R surface or pressing method can be adjusted by the number of sheets by further increasing the number of flat surfaces to three surfaces or four surfaces.

In addition, the lock can be changed to a firm hold with the protrusion angle and the carving angle of the key part 60 and joining grooves 36 as steep slopes.

Furthermore, synthetic resin which comprises the present invention is not particularly limited as long as the file can be formed. For example, polyolefin resin, such as polypropylene, propylene-ethylene random copolymer, propylene-ethylene block copolymer and polyethylene, can be used. In addition, filling material such as talc and calcium carbonate, coloring agent such as titanium oxide, and other stabilizers and nucleating agents can be added to each of these resins.

Figure 17:
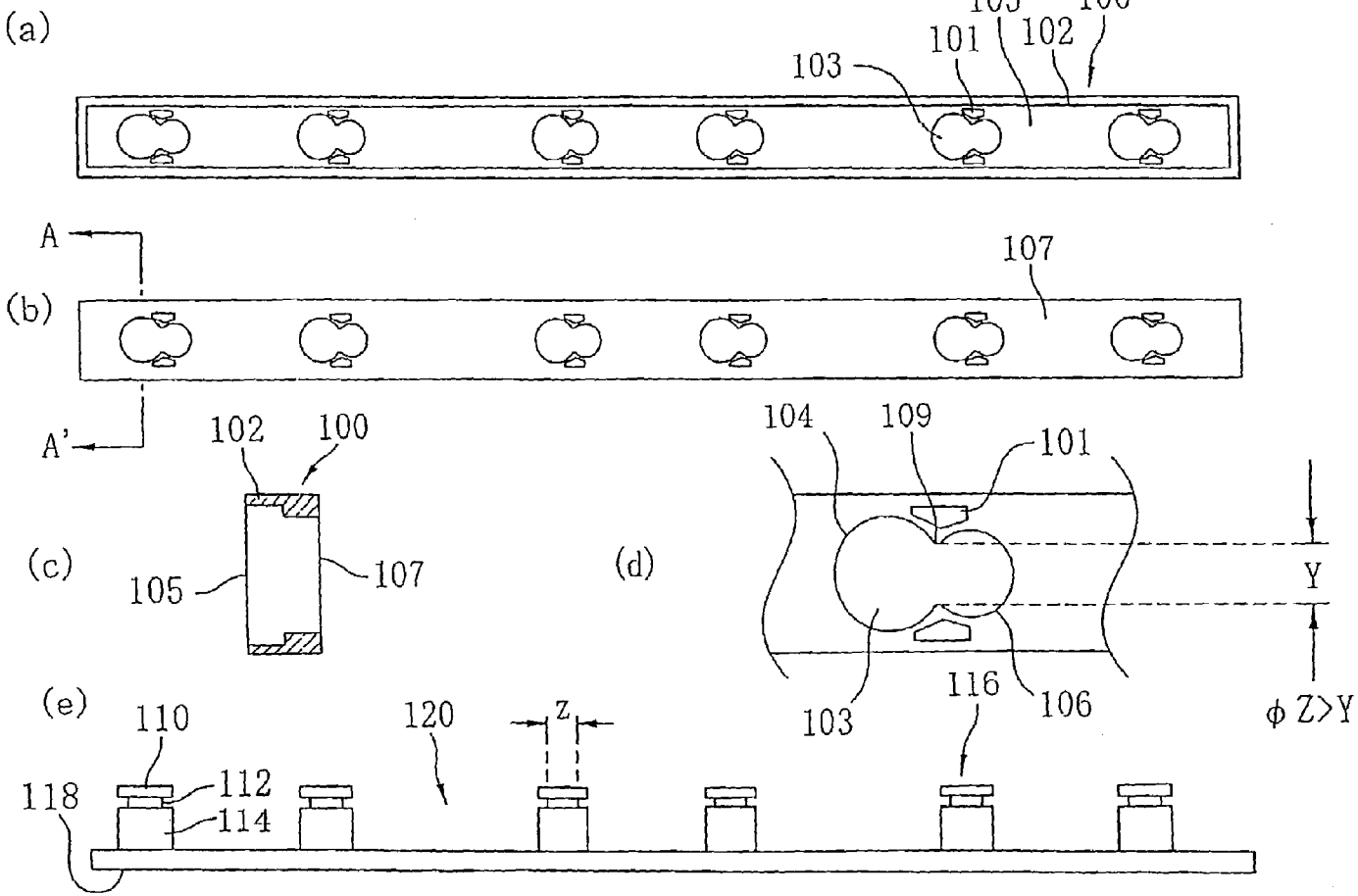
FIG. 17 shows a second embodiment of the binder for filing tools according to the present invention and is: (*a*) a rear view of a locking bar; (*b*) a front view of the locking bar; (*c*) a cross-sectional view of the release diameter hole part of the locking bar; (*d*) an enlarged view of the hole part on the rear surface of the locking bar; and (*e*) a side view of a band-shaped back board.
Figure 18:
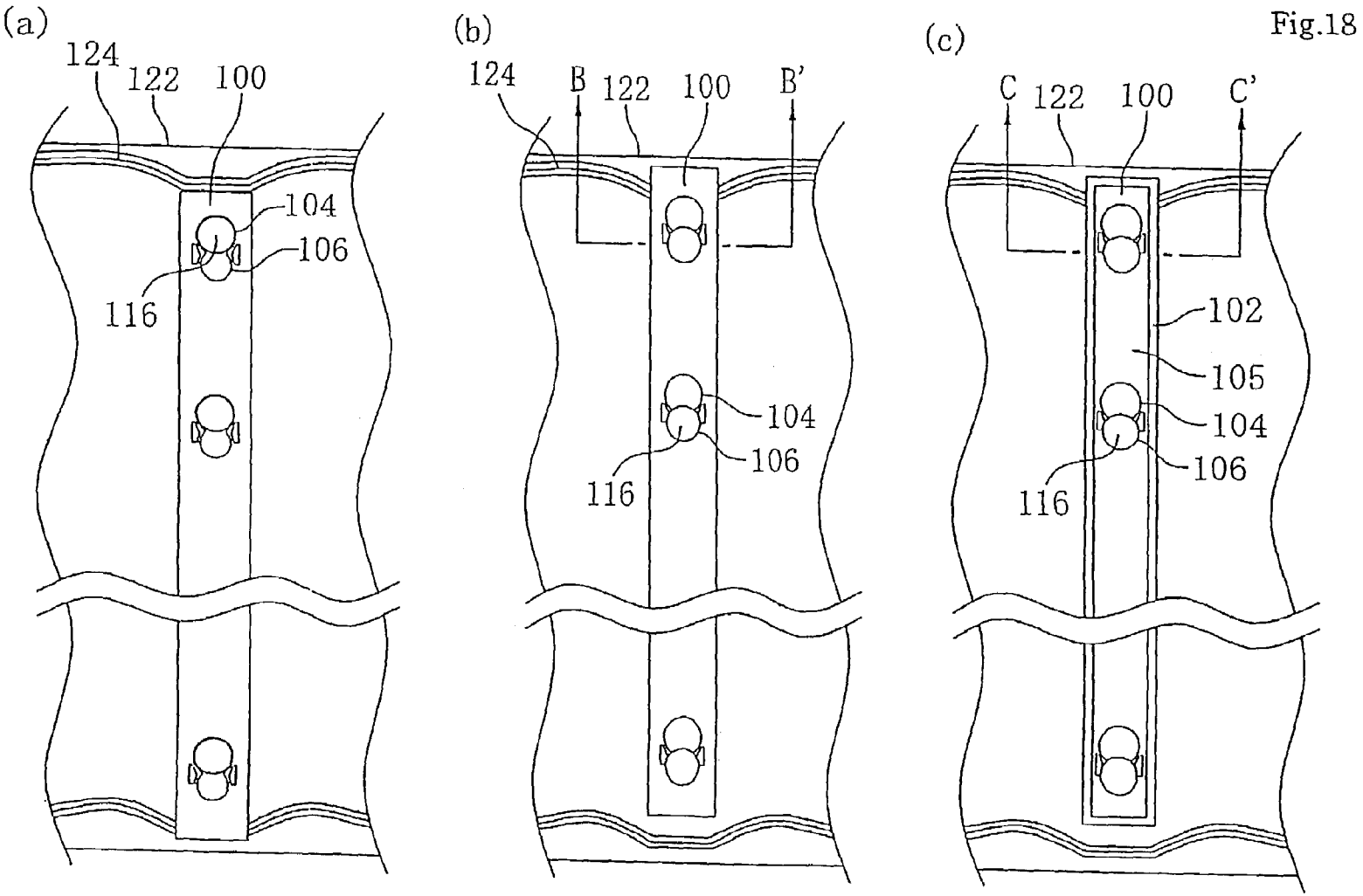
FIG. 18 shows the second embodiment of the binder for filing tools according to the present invention and is: (*a*) an enlarged view of the binder part when there are a few sheets and a diagram showing a state wherein the protruding part is on the release diameter hole part; (*b*) an enlarged view of the binder part when there are a few sheets and a diagram showing a state wherein the protruding part is locked by the lock diameter hole part; and (*c*) an enlarged view of the binder part when adding sheets and a diagram showing a state wherein the protruding part is locked by the lock diameter hole part.
Figure 19:
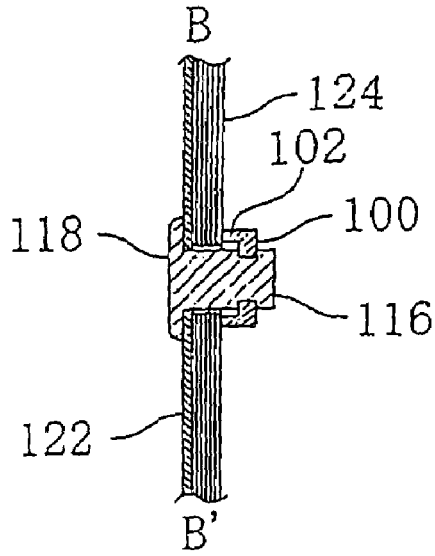
FIG. 19 shows the second embodiment of the binder for filing tools according to the present invention and is: (*a*) a cross-sectional view of the binder part when there are a few sheets; and (*b*) a cross-sectional view when adding sheets.
Figure 19:
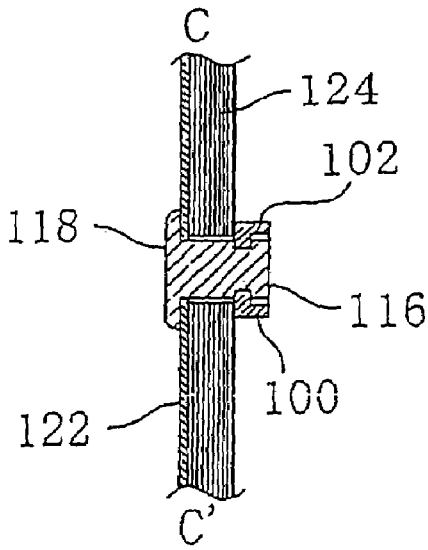

The second embodiment of the binder for filing tools of the present invention is shown in FIG. 17 to FIG. 19.

FIG. 17(*a*) is a rear view of a locking bar 100, (*b*) is a front view of the locking bar 100, (*c*) is an A-A' line cross-sectional view. Ribbing 102 are formed to protrude respectively from the outer four side edge parts of the rectangular locking bar 100 outwards and perpendicular to the rear surface 105 which is one of the surfaces. A plurality of hole parts 103 are formed to protrude from predetermined positions along the long axis direction of the locking bar 100, on the rear surface 105 of the locking bar 100. The hole parts 103 are formed in a state wherein the release diameter hole part 104 having a large diameter and a lock diameter hole part 106 having a small diameter are partially overlapping. A tying part 109 which has a width Y smaller than either diameter is provided in the joining part of this release diameter hole part 104 and lock diameter hole part 106. Deflection clearance hole part 101 is cut on both outer sides of this tying part 109 (FIG. 17(*d*)).

FIG. 17(*e*) is a side view of a band-shaped back board 120. In the band-shaped back board 120, the same number of cylindrical protruding parts 116 as the hole part 103 in the locking bar 100 are formed to protrude from positions corresponding to the hole parts 103 in a direction perpendicular to one surface of the bottom board par 118.

The protruding part 116 comprises, from the top, a vertex part 110, a locking groove part 112 of which the diameter is smaller than the vertex part 110, in the part therebelow, and an axis part 114 further below. Diameter Z of locking groove part 112 is set to be slightly larger than the width Y of the tying part 109.

Although the locking bar 100 can comprise flexible material, preferably, it is comprised of materials having rigidity.

Next, the mechanism of the present invention is described using FIG. 18 and FIG. 19.

A state wherein the front surface of the locking bar 100 faces outward and the protruding part 116 is positioned on the release diameter hole part 104 side is shown in FIG. 18(*a*), a state wherein the front surface of the locking bar 100 faces outward and the protruding part 116 is positioned on the lock diameter hole part 106 side is shown in FIG. 18(*b*), and a state wherein the rear surface of the locking bar 100 faces outward and the protruding part 116 is positioned on the lock diameter hole part 106 side is shown in FIG. 18(*c*).

Holes are provided in positions corresponding to the protruding parts 116 of the band-shaped back board 120, in the back cover part and sheet 124 of the front cover part 122. After the protruding part 116 is inserted into the hole part of the front cover part 122 and the hole part of the sheet, it is further inserted into the release diameter hole part 104, the locking bar 100 is slid in the lock diameter hole part 106 direction of the long axis direction, and the protruding part 116 is locked and held to the lock diameter hole part 106.

FIG. 19(*a*) is a B-B' line cross-sectional view of FIG. 18(*b*) and is a state wherein binding is when the sheets 124 are few. Locking bar 100 is bound with the front surface 107 on the outer side to the front cover part 122. FIG. 19(*b*) is similarly a C-C' line cross-sectional view of FIG. 18(*c*). When there are numerous sheets, the front and back of the locking bar 100 is reversed and bound with the rear surface 105 on the outer side to the front cover part 122.

Because the tying part 109 is provided in the hole part 103 of the locking bar 100, a suitable sense of running aground is created when manipulating the locking bar 100 by sliding, from open to locked state and from locked state to open.

In order to reduce the change in the foregoing suitable sense of running aground during slide manipulation and the sense of running aground due to repeated friction, a deflection clearance hole part 101 is provided on the outer side of the locking bar 100.

Because, in the locking bar 100, one side is provided as a ribbing structure wherein the peripheral part is lifted up, even less sheets can be bound such as not to move when the ribbing 102 is facing the front cover part 122 side from the groove part 112 of the protruding part 116 in a bound state (FIG. 19(*a*)), and even more sheets can be bound when the ribbing 102 is facing higher than the groove part 112 (FIG. 19(*b*)).

Figure 20:
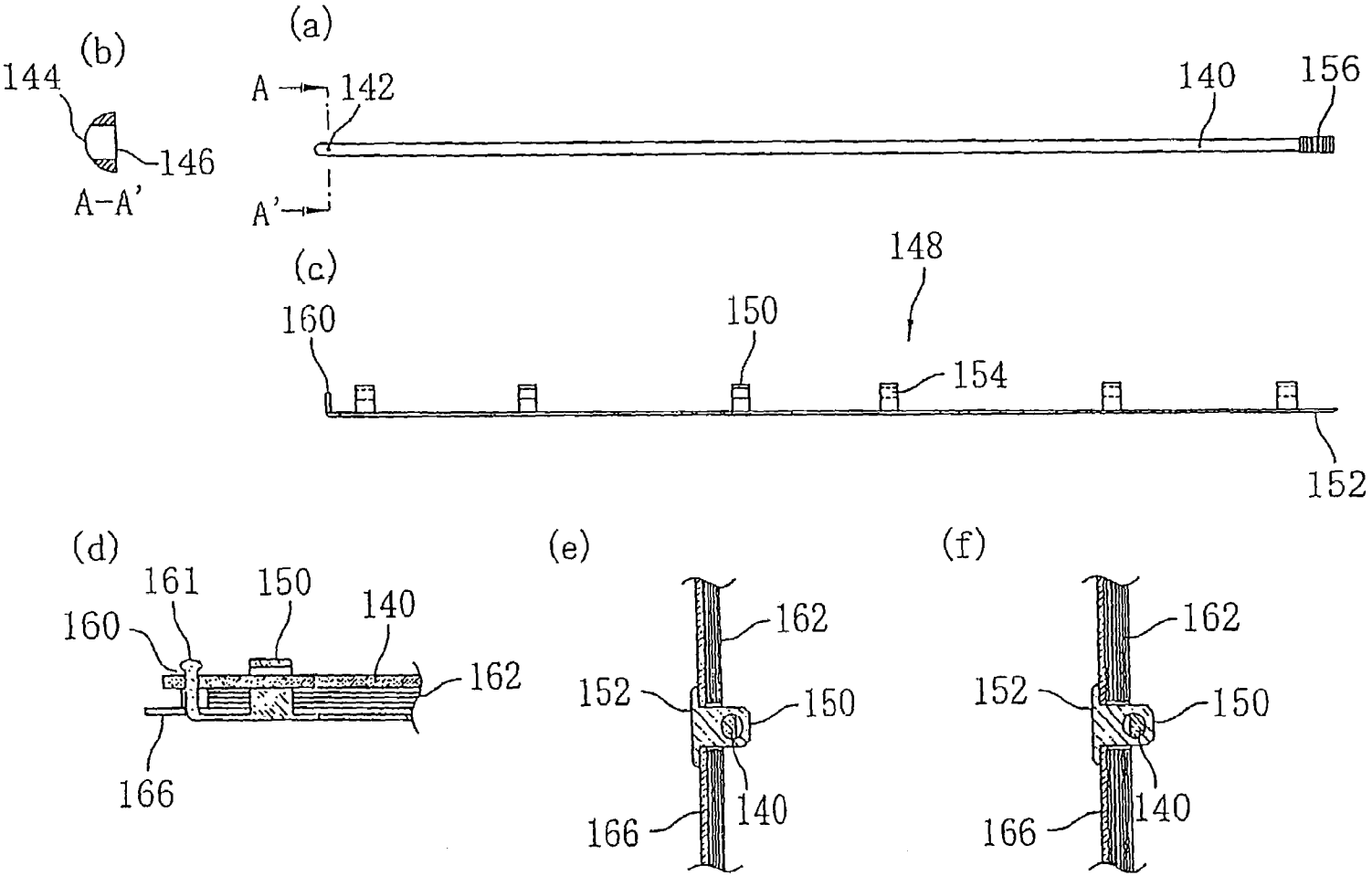
FIG. 20 shows a third embodiment of the binder for filing tools according to the present invention and is: (*a*) a front view of the locking bar; (*b*) a cross-sectional view of the locking bar; (*c*) a side view of the band-shaped back board; (*d*) a horizontal sectional view of the locking part; (*e*) a cross-sectional view of the binder part when there are a few sheets; and (*f*) a cross-sectional view of the binder part when adding sheets.

The third embodiment of the binder for filing tools of the present invention is shown in FIG. 20.

FIG. 20(*a*) is a front view of a locking bar 140. A hook hole part 142 is formed to protrude from one edge of the locking bar 140. A stopper 156 which is slightly wider than the locking bar 140 is provided on the other edge. FIG. 20(*b*) is an A-A' line cross-sectional view. The cross-section of the locking bar 140 is a semi-circle and comprised of a curved surface 144 and a flat surface 146. FIG. 20(*c*) is a side view of a band-shaped back board 148. Protruding parts 150 are formed on bottom board part 152 to protrude perpendicular to the bottom board part 152 with a predetermined distance in between. Circular hole parts 154 are drilled parallel to the long axis direction of the bottom board part 152 on the upper part of the protruding part 150. A hook part 160 is formed to protrude parallel to the protrusion part 150 on one edge part of the bottom board part 152. This hook part 160 is inserted into the hook hole part 142 and the locking bar is held.

The mechanism of the present embodiment is described in FIGS. 20(*d*), (*e*), and (*f*).

The locking bar 140 is inserted from the edge part having the hook hole part 142 from the circular hole part 154 of the protruding part 150 on the side opposite of the hook part 160 to be parallel with the bottom board part 152. When the tip of the locking bar 140 having the hook hole part 142 reaches the vicinity of the hook part 160, the hook part 160 is inserted into the hook hole part 142 of the locking bar 140. The cross-sectional view of the protruding part 150 adjacent to the hook part 160 at this time is shown in FIG. 18(*d*). The hook part 160 is inserted into the hook hole part 142 and the locking bar 140 is held. Here, the locking part 161 of the tip pf the hook part 160 has a wider diameter than the center of the hook part 160 and locks to the hook hole part 142 after insertion.

FIGS. 20(*e*) and (*f*) show cross-sectional views cut from the protruding part top part in the direction of bottom board part 152, perpendicular to the long-side direction of the bottom board part 152, and (*e*) shows a state wherein binding is when there are a few sheets 162. The curved surface 144 of the locking bar 140 is inserted into the circular hole part 154 such as to face the front cover part 166 side. If the curved surface 144 is placed to face to the front cover part 166 side, the locking bar 140 is placed on the front cover part 166 side in the circular hole part 154 and the distance between the locking bar 140 and the front cover part 166 becomes shorter. FIG. 20(*f*) reverses the front and rear of the locking bar 140 when there are many sheets or, in other words, the locking bar is inserted into the circular hole part 154 with the curved surface 144 facing the outer side to the front cover part 166. By enabling the flat surface 146 to face the front cover part 166 side, the distance between the locking bar 140 and the front cover part 166 becomes long by the locking bar 140 being placed on the side opposite to the front cover part 166 and inserting. In other words, by making the cross-section of the locking bar 140 a semi-circle, the distance between the back cover part front surface and the locking bar 140 can be changed with the front and rear.

Although the locking bar 140 can be constructed from material which is very flexible, it is more preferable to use rigid resin material which is very elastic, such as nylon, in order to lock and release the hook part 160 with resin elasticity.

Figure 21:
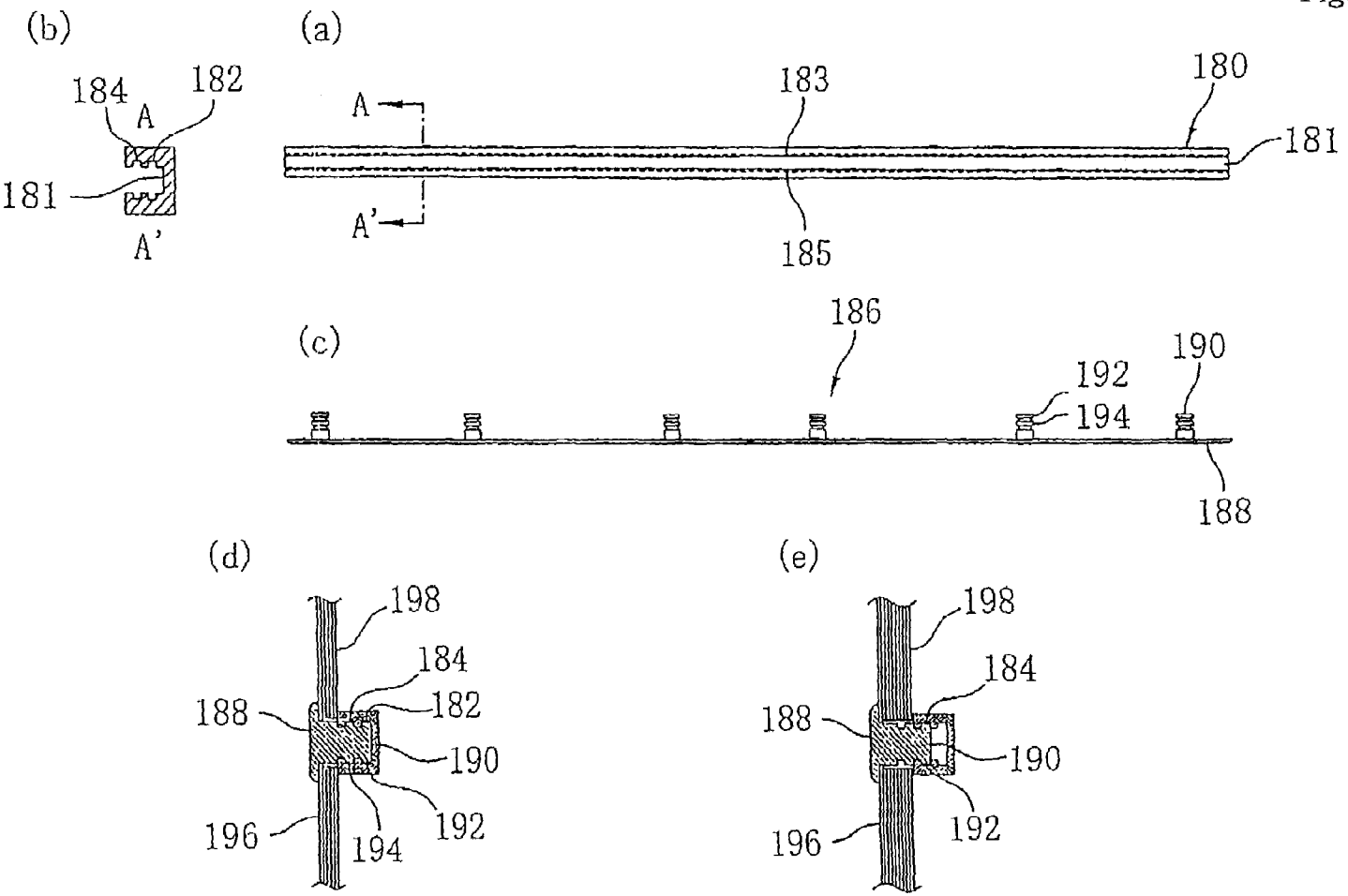
FIG. 21 shows a fourth embodiment of the binder for filing tools according to the present invention and is: (*a*) a front view of the locking bar; (*b*) a cross-sectional view of the locking bar; (*c*) a side view of the band-shaped back board; (*d*) a cross-sectional view of the binder part when there are a few sheets; and (*e*) a cross-sectional view of the binder part when adding sheets.

A fourth embodiment of the binder for filing tools of the present invention is shown in FIG. 21.

FIG. 21(*a*) is a front view of a locking bar 180 and FIG. 21(*b*) is an A-A' line cross-sectional view. The locking bar 180 comprises ribbings 183 and 185 formed to protrude perpendicular to surface 181 on both long sides of one of the surface 181, and two groove parts 182 and 184 are carved on the surface opposing both ribbings 183 and 185. Of the two groove parts, that closer to surface 181 is the inner groove part 182 and that farther from the surface is the outer groove part 184.

FIG. 21(*c*) is a side view of a band-shaped back board 186. Cylindrical protruding parts 190 are formed to protrude perpendicular to one of the surfaces on the bottom board part 188 with predetermined distance in between. Two orbital ribbings are provided on the top part and the lower part of the protruding part 190. These orbital ribbings are a first orbital ribbing 192 and a second orbital ribbing 194, in sequential order from the top part of the protruding part 190. They are set to equal sizes to interlock with the inner groove part 182 and outer groove part 184 of the locking bar 180.

Next, the mechanism of the present embodiment is described.

The locking bar 180 is slid from the protruding part 190 of either one of the edge parts of the band-shaped back board 186 and is locked or released.

In FIG. 21(*d*), if there are a few number of sheets 198 layered over a front cover 196, the protruding part 190 is inserted into the locking bar 180 such that the top part of the protruding part 190 contacts the surface 181, and the inner groove part 182 and the first orbital ribbing 192, and the outer groove part 184 and the second orbital ribbing 194 are interlocked. In FIG. 21(*e*), if the number of sheets is increased, the protruding part 190 is inserted such that the top part of the protruding part and the surface 181 are in a separated state. In other words, the outer groove part 184 and the first orbital ribbing 192 interlock.

Although the locking bar 180 can be injection molded by synthetic resin, extrusion molding which is cheap in initial investment costs is preferable. In addition, although the locking bar 180 can be composed of a material having flexibility, it is preferably composed of a material having rigidity.

Figure 22:
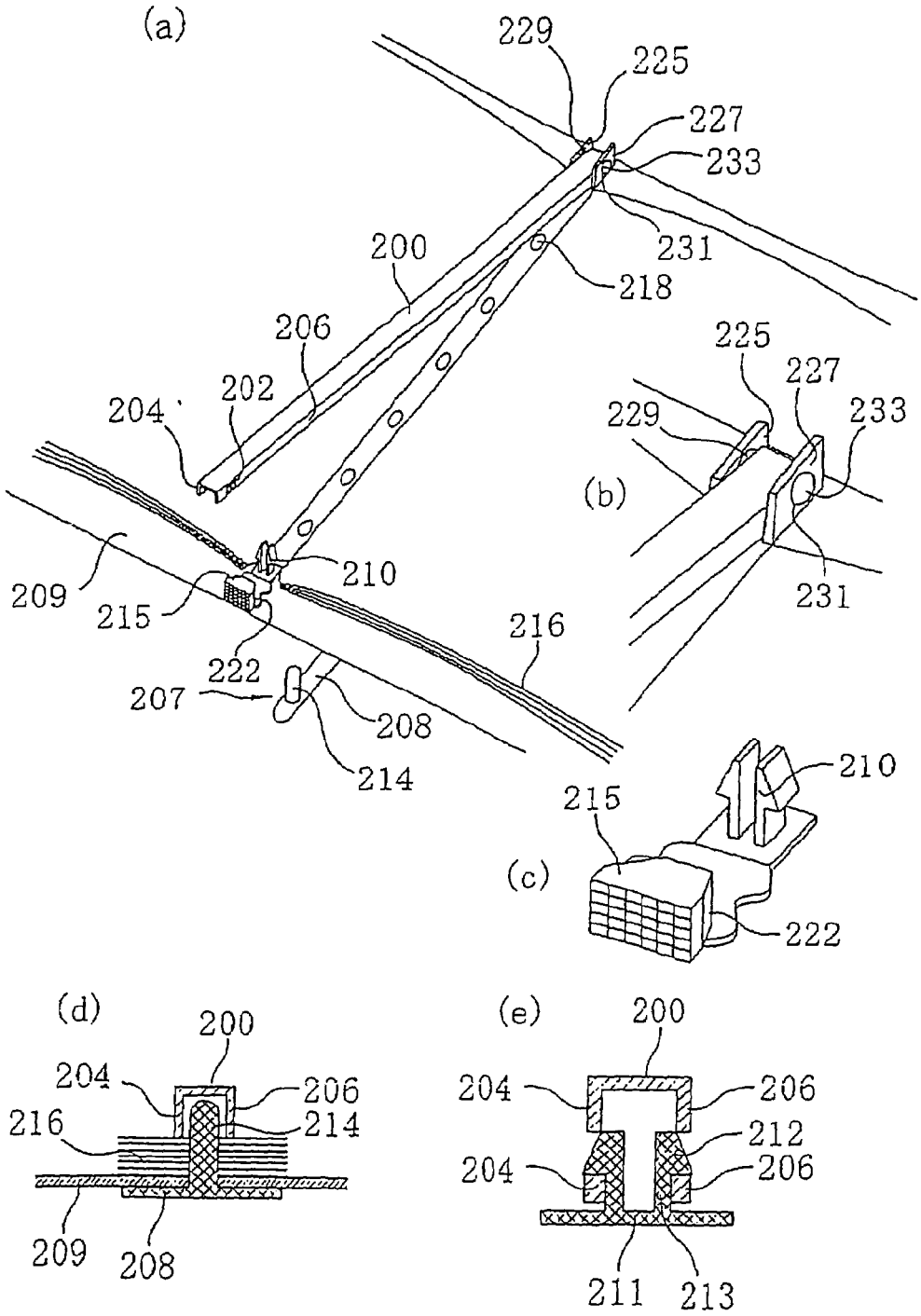
FIG. 22 shows a fifth embodiment of the binder for filing tools according to the present invention and is: (*a*) a configuration diagram of the file; (*b*) an enlarged view of the support point of the locking bar; (*c*) an enlarged view of the latching part; (*d*) a cross-sectional view of a portion including the protruding part in a state wherein the sheet is bound and the locking bar is closed; and (*e*) a cross-sectional view of a position including the latching part in a state wherein the locking bar is closed.

A fifth embodiment of the binder for filing tools of the present invention is described using FIG. 22.

As shown in FIG. 22(*a*), locking bar 200 comprises ribbings 204 and 206 formed to protrude perpendicular to the surface on both long sides of one of the surfaces, and rectangular hooking hole parts 202 are provided respectively on the edge parts of both ribbings 204 and 206. On the other hand, flat boards 225 and 227 are erected facing each other, perpendicular to the back cover part of the front cover 209. Through-holes 229 and 231 are opened in the center of the flat boards 225 and 227, and through-holes 229 and 231 are held by pin 233, and locking bar 200 is held to enable rotation with pin 233 as the center.

A plurality of hole parts 218 are provided with predetermined distance in between in the portion of the front cover 209 corresponding to the back cover part and of sheet 216 corresponding to the back cover part. In the band-shaped back board 207, the same number of cylindrical protruding parts 214 are provided on the bottom board part 208 as the hole part 218 and with distance corresponding to the hole part 218 in between.

FIG. 22(*c*) shows an enlarged view of a holding tool 210. The holding tool 210 comprises two flat board parts 213 for latching onto the hooking hole part 202 of the locking bar 200. Two flat board parts 213 are formed to protrude parallel to the locking bar 200, perpendicular from the bottom part 211 attached to the front cover 209, and tapered latching parts 212 are provided in the upper parts of the flat board parts 213 facing the opposite direction of each other. The distance between the two flat board parts 213 is set to a width wherein the locking bar 200 can be inserted between the ribbings 204 and 206.

Flat boards 225 and 227 and a pressing part 215 which is at the opposite edge part and has more predetermined distance in between than the holding tool 210 are erected on the bottom board part 208. As shown in FIG. 22(*c*), double-side surface taper parts 222 are formed in the flat board 225 and 227 direction on both side surfaces of the pressing part 215. Tapering is formed such that the tip becomes narrower with the sloping direction towards the long axis direction of the locking bar 200.

The mechanism of the present embodiment is described by FIGS. 22(*d*) and (*e*).

The hole parts 218 of the front cover 209 and sheets 216 are inserted into the protruding parts 214, the locking bar 200 rotates with pin 233 as its axis, the hooking hole part 202 locks onto the flat board part 213, ribbings 204 and 206 press the sheets 216, thereby holding the sheets 216. A cross-sectional view of the portion including the protruding parts 214 in a state wherein the sheets 216 are bound and locking bar 200 is closed is shown in FIG. 22(*d*).

FIG. 22(*e*) is a cross-sectional view of the position including the latching part 212 in a state wherein the locking bar 200 is closed. The latching part is locked onto the hooking hole part 202 and the locking bar 200 is prevented from detaching.

When removing locking bar 200 from the latching part 212, the double-side surface taper part 222 bends the ribbings 204 and 206 of the locking bar 200 in the outward direction when the pressing part 215 presses the locking bar 200 from the rear surface. Therefore, the hooking hole part 202 is released from the latching part 212 and the locking bar 200 can be removed easily.

Although locking bar 200 can be composed of materials having flexibility, it is ideal if it is composed if materials having rigidity.

Figure 23:
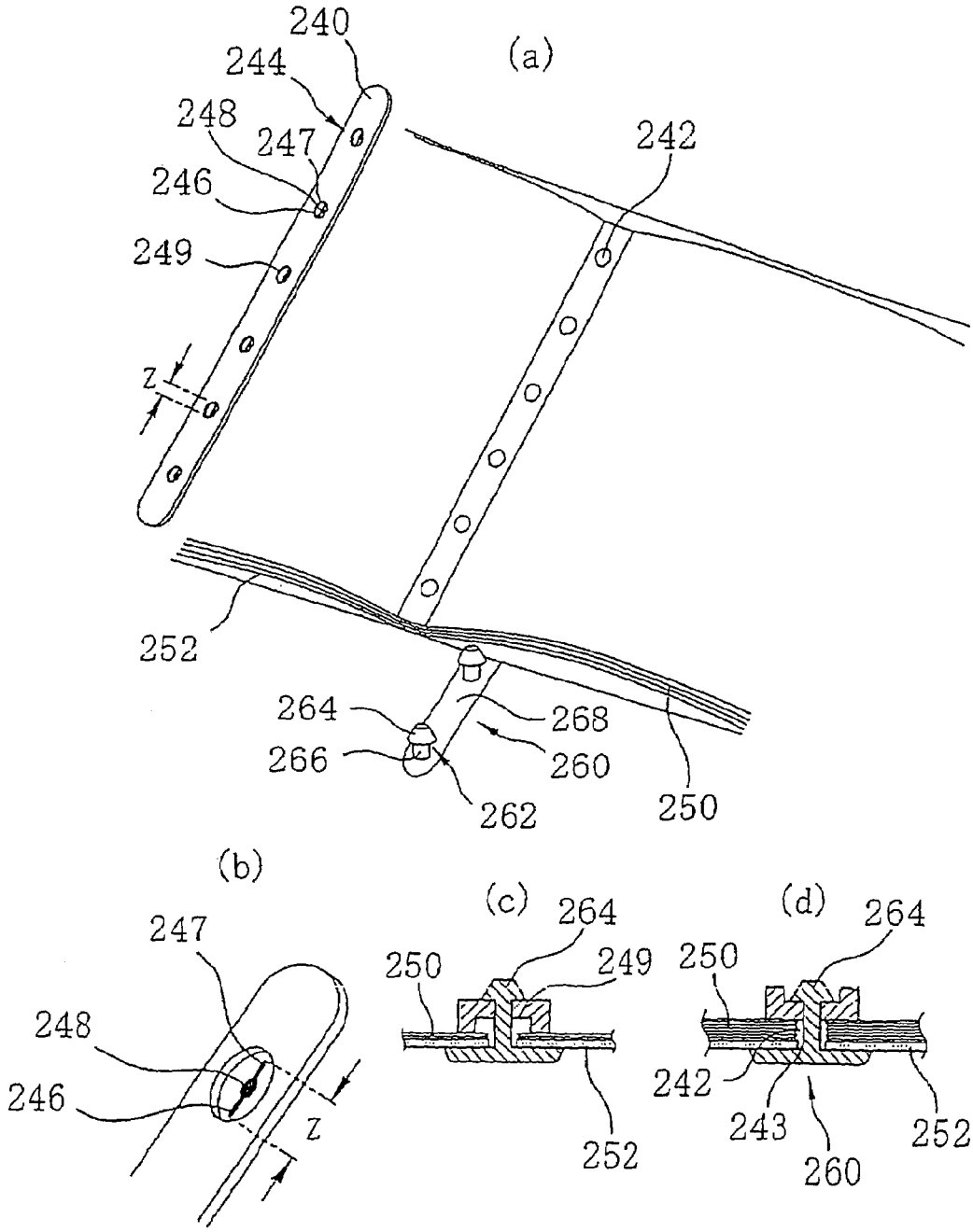
FIG. 23 shows a sixth embodiment of the binder for filing tools according to the present invention and is: (*a*) a configuration diagram of the file; (*b*) an enlarged view of the carved part of the flexible locking bar; (*c*) a cross-sectional view of the binder part when there are a few sheets; and (*d*) a cross-sectional view of the binder part when adding sheets.

A sixth embodiment of the binder for filing tools pf the present invention is described using FIGS. 23(*a*) to (*d*).

In the flexible locking bar 240, a plurality of opening parts 244 are provided with a predetermined distance therebetween, as shown in FIG. 23(*a*). The opening part 244 is carved in a circular shape. A round hole part 248 is provided in the center of this carved part 249, and two slit parts 246 and 247 are provided linearly, parallel to the long axis direction of the flexible locking bar 240 and concentric with each round hole part 248 (FIG. 23(*b*)). The same number of hole parts 242 and 243 as the opening parts 244 are provided with the same distance in between in the back cover parts of the sheets 250 and the front cover 252.

A band-shaped back board 260 is formed from the bottom board part 268 and the protruding parts 262, and the protruding parts 262 are formed from tapered ribbings 264 on the tip of the axis part 266. The diameter of the ribbings 264 is set to be almost the same as length Z of the slit parts 246 and 247. The diameter of axis part 266 is set to be almost the same degree as the diameter of the round hole part 248.

The mechanism of the present embodiment is described.

The protruding parts 262 of the band-shaped back board 260 are inserted into the hole parts 243 of the front cover 252 and the hole parts 242 of the sheets 250 and also are inserted into the opening parts 244 of the flexible locking bar 240. Ribbings 264 which have a diameter larger than the round hole parts 248 can be inserted whereby the slit parts 246 and 247 open, and the detachment of the protruding parts 262 from the flexible locking bar 240 when the slit parts 246 and 247 are closed is prevented.

The thickness of the sheets which can be bound change by choosing the front or rear of the flexible locking bar 240 when locking the file. A cross-sectional view of the binder part when there are a few numbers of sheets is shown in FIG. 23(*c*). If the surface of the carved part 249 is on the sheet side, the lower surface of the ribbings 264 of the protruding parts 262 contacts the surface on the opposite side of the carved part 249, the distance between the front cover 252 and the flexible locking bar 240 is reduced by the depth of the carved part, and a few numbers of sheets 250 can be bound. A cross-sectional view of the binder part when adding sheets is shown in FIG. 23(*d*). If the surface opposite of the carved part 249 is on the sheet side, the lower surface of the ribbing 264 fitted to the opening part 244 contacts the bottom surface of the carved part 249, the distance between the flexible locking bar 240 and the front cover 252 increases, and a large number of sheets 250 can be bound.

The flexible locking bar 240 is composed of soft materials such as polyethylene.

The invention claimed is:

1. A binder for filing tools which binds sheets having a plurality of sheet hole parts aligned in the center, comprising a locking bar which corresponds to a front cover wherein two front cover parts formed from flat boards are connected to a back cover part by one side, respectively, and integrated, comprising:

a space setting means wherein the sheets are placed such as to be held between the locking bar and the front cover and the distance between the locking bar and the front cover is set arbitrarily according to the number of sheets to be bound, wherein said back cover part comprises a plurality of key-shaped locking parts erected on the front surface thereof, the key-shaped locking part is penetrated through the sheet hole parts in said sheets, a plurality of tying parts are provided in said locking bar in positions corresponding to the positions of the key-shaped locking parts, and the sheets are held between the locking bar and front cover by each tying part being locked to the key-shaped locking part, wherein the locking bar comprises a tying part having a small diameter and a pressure part having a diameter larger than that of the tying part, and wherein, in the pressure part, the center axis line of the tying part is provided at a slant in a specific direction from the center axis of the pressure.

2. The binder for filing tools according to claim 1, wherein the space setting means sets distance according to the distance between the front cover and each surface, when the locking bar which has a first surface and a second surface which is opposite to the first surface holds the sheet.

3. The binder for filing tools according to claim 1 comprising a band-shaped back board which is shorter in length than a back cover part provided on the front surface of said front cover and a locking bar corresponding to the band-shaped back board on the rear side of the back cover part, wherein:

a plurality of back hole parts are provided in the back cover part, the band-shaped back board comprises a plurality of key-shaped locking parts erected on the front surface thereof, this key-shaped locking part penetrates the plural back hole parts provided on the back cover part, the key-shaped locking part penetrates the sheet hole parts of said sheet, a plurality of tying parts are provided in said locking bar on the location corresponding to the locations of these key-shaped locking parts, and the sheet is held between the locking bar and the front cover by locking each tying part to the key-shaped locking part.

4. The binder for filing tools according to claim 1, wherein the sheets are formed into a transparent pouch-shape wherein the center part is pressure bonded, a plurality of holes are provided and, additionally, an opening part is provided in the upper part.

5. The binder for filing tools according to claim 1, wherein, in the locking bar, an attaching concave part is carved into the center thereof in order to insert a thin board and enable horizontal movement.

6. The binder for filing tools according to claim 1, wherein the tying part comprises a locking part, on to which a joining groove is carved in the long axis direction, and a circular part composed of a curved surface.

7. The binder for filing tools according to claim 6, wherein the joining groove is notched in four point symmetrical points of the circular curved surface.

8. The binder for filing tools according to claim 1, wherein, in the key-shaped locking part, key parts which are provided on the tip of a pinching part for sandwiching the locking bar therebetween both protrude inwards.

9. The binder for filing tools according to claim 1, wherein, in a locking part which is carved onto the tying part, a nonslip protrusion part is formed to protrude from the center thereof to lock the key part.

10. The binder for filing tools according to claim 1, wherein, a joining groove and a joining groove bottom part of the locking bar are carved at an acute angle in accordance to the key-shaped locking part of an engaging band-shaped back board.

11. The binder for filing tools according to claim 1, wherein a ribbing is provided and a plurality of hole parts in a shape wherein two circles of differing diameters are partially joined is formed on the one side peripheral part of the locking bar.

12. The binder for filing tools according to claim 4, wherein the locking bar has a plurality of hole parts drilled along its long axis in predetermined locations, the hole part is formed such that an release diameter hole part having a large diameter and a lock diameter hole part having a small diameter partially overlap, and a locking groove part provided on the protrusion part which is formed to protrude perpendicularly from the back cover part is locked and held in the hole part.

13. The binder for filing tools according to claim 1, wherein the locking bar formed in a rectangle and ribbing is formed on the outer four-side edge part to protrude perpendicularly and outwards to a surface of the locking bar.

14. The binder for filing tools according to claim 1, wherein the locking bar is formed from an arc-shaped curved surface, of which the center is the center of axle, and a flat surface and penetrates the circular hole part which passes through, parallel in the long axis direction of the back cover part, the protrusion part which is formed to protrude perpendicularly from the back cover part.

15. The binder filing tools according to claim 1, wherein the locking bar is rectangular, grooves are carved on the surface opposing a plurality of ribbings protruding from the entire long-side edge, and the grooves interlock with an orbital ribbing provided on the protrusion part which protrudes perpendicularly from the back cover part.

16. The binder for filing tools according to claim 1, wherein the locking bar comprises ribbing protruding perpendicularly on the surfaces on both long sides of one surface, a rectangular hooking hole part provided on the one edge part of the ribbing and a first pin hole drilled on the other edge part of the ribbing, respectively, is composed of a flat board which is erected perpendicular to and opposing the back cover part, a second pin hole which is drilled in the center of the flat board, a pin which penetrates the first pin hole and the second pin hole and holds the locking bar to enable rotation, and a second flat board part which is formed to protrude perpendicular to the back cover part from the holding part provided on the other edge of the back cover part and comprises a latching part on the side surface, and the latching part locked onto the hooking hole part and holds the locking bar.

17. The binder for filing tools according to claim 1, wherein the locking bar comprises a carved part which is carved into a plurality of circles, a slit which is cut into the center of the carved part, and a protrusion which comprises orbital ribbing, formed to protrude by the back cover part, and the locking bar is fixed onto the protrusion.

18. The binder for filing tools according to claim 1, wherein the locking bar is composed of a flexible locking bar which has flexibility.

19. A binder for filing tools which binds sheets having a plurality of sheet hole parts aligned in the center, comprising a locking bar which corresponds to a front cover wherein two front cover parts formed from flat boards are connected to a back cover part by one side, respectively, and integrated, comprising:

a space setting means wherein the sheets are placed such as to be held between the locking bar and the front cover and the distance between the locking bar and the front cover is set arbitrarily according to the number of sheets to be bound, wherein said back cover part comprises a plurality of key-shaped locking parts erected on the front surface thereof, the key-shaped locking part is penetrated through the sheet hole parts in said sheets, a plurality of tying parts are provided in said locking bar in positions corresponding to the positions of the key-shaped locking parts, and the sheets are held between the locking bar and front cover by each tying part being locked to the key-shaped locking part, and wherein, in the key-shaped locking part, a board-shaped stopper part which is lower in height than opposing pinching parts is formed between the opposing pinching parts to protrude perpendicular to the back cover part.

20. The binder for filing tools according to claim 19, wherein the space setting means sets distance according to the distance between the front cover and each surface, when the locking bar which has a first surface and a second surface which is opposite to the first surface holds the sheet.

21. The binder for filing tools according to claim 19 comprising a band-shaped back board which is shorter in length than a back cover part provided on the front surface of said front cover and a locking bar corresponding to the band-shaped back board on the rear side of the back cover part, wherein:

a plurality of back hole parts are provided in the back cover part, the band-shaped back board comprises a plurality of key-shaped locking parts erected on the front surface thereof, this key-shaped locking part penetrates the plural back hole parts provided on the back cover part, the key-shaped locking part penetrates the sheet hole parts of said sheet, a plurality of tying parts are provided in said locking bar on the location corresponding to the locations of these key-shaped locking parts, and the sheet is held between the locking bar and the front cover by locking each tying part to the key-shaped locking part.

22. The binder for filing tools according to claim 19, wherein the sheets are formed into a transparent pouch-shape wherein the center part is pressure bonded, a plurality of holes are provided and, additionally, an opening part is provided in the upper part.

23. The binder for filing tools according to claim 19, wherein, in the locking bar, an attaching concave part is carved into the center thereof in order to insert a thin board and enable horizontal movement.

24. The binder for filing tools according to claim 19, wherein the tying part comprises a locking part, on to which a joining groove is carved in the long axis direction, and a circular part composed of a curved surface.

25. The binder for filing tools according to claim 24, wherein the joining groove is notched in four point symmetrical points of the circular curved surface.

26. The binder for filing tools according to claim 19, wherein, in the key-shaped locking part, key parts which are provided on the tip of a pinching part for sandwiching the locking bar therebetween both protrude inwards.

27. The binder for filing tools according to claim 19, wherein, in a locking part which is carved onto the tying part, a nonslip protrusion part is formed to protrude from the center thereof to lock the key part.

28. The binder for filing tools according to claim 19, wherein, a joining groove and a joining groove bottom part of the locking bar are carved at an acute angle in accordance to the key-shaped locking part of an engaging band-shaped back board.

29. The binder for filing tools according to claim 19, wherein a ribbing is provided and a plurality of hole parts in a shape wherein two circles of differing diameters are partially joined is formed on the one side peripheral part of the locking bar.

30. The binder for filing tools according to claim 29, wherein the locking bar has a plurality of hole parts drilled along its long axis in predetermined locations, the hole part is formed such that an release diameter hole part having a large diameter and a lock diameter hole part having a small diameter partially overlap, and a locking groove part provided on the protrusion part which is formed to protrude perpendicularly from the back cover part is locked and held in the hole part.

31. The binder for filing tools according to claim 19, wherein the locking bar formed in a rectangle and ribbing is formed on the outer four-side edge part to protrude perpendicularly and outwards to a surface of the locking bar.

32. The binder for filing tools according to claim 19, wherein the locking bar is formed from an arc-shaped curved surface, of which the center is the center of axle, and a flat surface and penetrates the circular hole part which passes through, parallel in the long axis direction of the back cover part, the protrusion part which is formed to protrude perpendicularly from the back cover part.

33. The binder filing tools according to claim 19, wherein the locking bar is rectangular, grooves are carved on the surface opposing a plurality of ribbings protruding from the entire long-side edge, and the grooves interlock with an orbital ribbing provided on the protrusion part which protrudes perpendicularly from the back cover part.

34. The binder for filing tools according to claim 19, wherein the locking bar comprises ribbing protruding perpendicularly on the surfaces on both long sides of one surface, a rectangular hooking hole part provided on the one edge part of the ribbing and a first pin hole drilled on the other edge part of the ribbing, respectively, is composed of a flat board which is erected perpendicular to and opposing the back cover part, a second pin hole which is drilled in the center of the flat board, a pin which penetrates the first pin hole and the second pin hole and holds the locking bar to enable rotation, and a second flat board part which is formed to protrude perpendicular to the back cover part from the holding part provided on the other edge of the back cover part and comprises a latching part on the side surface, and the latching part locked onto the hooking hole part and holds the locking bar.

35. The binder for filing tools according to claim 19, wherein the locking bar comprises a carved part which is carved into a plurality of circles, a slit which is cut into the center of the carved part, and a protrusion which comprises orbital ribbing, formed to protrude by the back cover part, and the locking bar is fixed onto the protrusion.

36. The binder for filing tools according to claim 19, wherein the locking bar is composed of a flexible locking bar which has flexibility.

* * * * *

UNITED STATES PATENT AND TRADEMARK OFFICE

CERTIFICATE OF CORRECTION

PATENT NO. : 7,575,388 B2
APPLICATION NO. : 10/550296
DATED : August 18, 2009
INVENTOR(S) : Shimada et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 743 days.

Signed and Sealed this

Seventh Day of September, 2010

David J. Kappos

David J. Kappos
*Director of the United States Patent and Trademark Office*